US008261377B2

(12) United States Patent
Oh

(10) Patent No.: US 8,261,377 B2
(45) **Date of Patent: *Sep. 11, 2012**

(54) BIDET FOR TOILET BOWL

(76) Inventor: Young-Kuk Oh, Seoul (KR)

( * ) Notice: Subject to any disclaimer, the term of this patent is extended or adjusted under 35 U.S.C. 154(b) by 1153 days.

This patent is subject to a terminal disclaimer.

(21) Appl. No.: 11/994,108

(22) PCT Filed: Jun. 14, 2006

(86) PCT No.: PCT/KR2006/002269

§ 371 (c)(1),
(2), (4) Date: Dec. 27, 2007

(87) PCT Pub. No.: WO2007/004790

PCT Pub. Date: Jan. 11, 2007

(65) Prior Publication Data

US 2008/0201837 A1 Aug. 28, 2008

(30) Foreign Application Priority Data

Jun. 30, 2005 (KR) ..... 10-2005-0057524

(51) Int. Cl.
*E03D 9/08* (2006.01)

(52) U.S. Cl. ..... 4/420.5; 4/420.1; 4/448; 601/160

(58) Field of Classification Search ..... 4/420.1–420.5, 4/443–448; 601/154, 160; 604/22, 39, 279
See application file for complete search history.

(56) References Cited

U.S. PATENT DOCUMENTS 4,160,292 A * 7/1979 Kuether et al. ..... 4/615
4,406,025 A 9/1983 Huck et al.
4,441,219 A * 4/1984 Epstein ..... 4/448
4,450,596 A * 5/1984 Cohen ..... 4/447
4,451,942 A * 6/1984 Hirano et al. ..... 4/420.2
4,550,454 A * 11/1985 Yui ..... 4/420.4
4,553,274 A * 11/1985 Yui ..... 4/420.4
4,558,473 A * 12/1985 Morikawa et al. ..... 4/420.2
4,642,820 A * 2/1987 Boring, Jr. ..... 4/420.4
4,688,275 A * 8/1987 Kuo ..... 4/443
4,807,311 A * 2/1989 Ingels ..... 4/443
5,208,922 A * 5/1993 Machinaga et al. ..... 4/448
5,304,116 A * 4/1994 Cornelius ..... 604/39

(Continued)

FOREIGN PATENT DOCUMENTS

CN 1103917 A 6/1995

(Continued)

*Primary Examiner* — Basil Katcheves
*Assistant Examiner* — Rodney Mintz
(74) *Attorney, Agent, or Firm* — Park & Associates IP Law, P.C.

(57) ABSTRACT

A bidet device for toilet bowls is mounted on a toilet bowl for washing an anus and the inner part of an intestine or a vagina, and includes a main body (10) mounted on a rear side of a toilet bowl and having a control part C, a main wash bidet part (15) provided below a center protrusion (11) of the main body (10) for spraying water, an in-body wash bidet part (30 or 40) attached to the main body (10) for cleansing the intestine and the vagina, a purifier part (20) for purifying the water ejected through the main wash bidet part (15) and the in-body wash bidet part (30 or 40), and a water ejection regulator part (14) provided on the control part C for selectively supplying the water to one of the main wash bidet part (15) and the in-body wash bidet part (30 or 40).

12 Claims, 15 Drawing Sheets

U.S. PATENT DOCUMENTS

| | | | | |
|---|---|---|---|---|
| 5,380,275 | A * | 1/1995 | Kensey et al. | 604/27 |
| 5,452,483 | A * | 9/1995 | Dizon, Jr. | 4/420.4 |
| 5,572,748 | A * | 11/1996 | Nee | 4/420.2 |
| 5,647,069 | A * | 7/1997 | Han et al. | 4/420.2 |
| 5,826,282 | A * | 10/1998 | Matsumoto et al. | 4/420.4 |
| 5,864,895 | A * | 2/1999 | Ota et al. | 4/443 |
| 5,960,484 | A * | 10/1999 | Shao | 4/420.4 |
| 5,960,485 | A * | 10/1999 | Mihara | 4/443 |
| 5,960,486 | A * | 10/1999 | Huliganga | 4/447 |
| 5,987,660 | A * | 11/1999 | Wang | 4/420.4 |
| 6,006,372 | A * | 12/1999 | Chang | 4/420.2 |
| 6,035,458 | A * | 3/2000 | Tarzia | 4/443 |
| 6,167,577 | B1 * | 1/2001 | Hammad | 4/420.4 |
| 6,178,568 | B1 * | 1/2001 | Boulieris | 4/420.4 |
| 6,430,366 | B1 * | 8/2002 | Mizutani et al. | 392/449 |
| 6,473,913 | B1 * | 11/2002 | Bell, Sr. | 4/448 |
| 6,503,220 | B1 * | 1/2003 | Cirillo et al. | 604/39 |
| 6,526,602 | B2 | 3/2003 | Jeon | |
| 6,649,884 | B2 * | 11/2003 | Nonomura | 219/494 |
| RE38,690 | E * | 2/2005 | Moon | 4/420.1 |
| 7,013,502 | B2 * | 3/2006 | Pacheco | 4/420.2 |
| 7,065,082 | B2 * | 6/2006 | Ganesh et al. | 370/392 |
| 7,127,750 | B2 * | 10/2006 | Lim | 4/420.4 |
| RE39,930 | E * | 12/2007 | Moon | 4/448 |
| 7,318,242 | B2 * | 1/2008 | Pace | 4/420.4 |
| 7,335,175 | B2 * | 2/2008 | Heilman | 601/155 |
| 7,762,997 | B2 * | 7/2010 | Adjani et al. | 604/279 |
| 7,805,778 | B2 * | 10/2010 | Liao | 4/406 |
| 8,037,553 | B2 * | 10/2011 | Ware | 4/420.5 |
| 8,060,953 | B1 * | 11/2011 | Dorra | 4/233 |
| 8,065,755 | B2 * | 11/2011 | Chen | 4/420.4 |
| 2001/0022006 | A1 * | 9/2001 | Tomita et al. | 4/420.4 |
| 2002/0042946 | A1 * | 4/2002 | Jeon | 4/420.4 |
| 2003/0140408 | A1 * | 7/2003 | Chung | 4/443 |
| 2003/0163864 | A1 * | 9/2003 | Haan | 4/420.4 |
| 2005/0197604 | A1 * | 9/2005 | Heilman | 601/160 |
| 2006/0037129 | A1 * | 2/2006 | Bhatnagar | 4/420.4 |
| 2006/0084895 | A1 * | 4/2006 | Adjani et al. | 601/155 |
| 2006/0150310 | A1 * | 7/2006 | Tsai | 4/420.1 |
| 2006/0253967 | A1 * | 11/2006 | Wu | 4/420.4 |
| 2006/0264851 | A1 * | 11/2006 | Coleman | 604/279 |
| 2007/0089226 | A1 * | 4/2007 | Chen | 4/447 |
| 2007/0094782 | A1 * | 5/2007 | Park | 4/420.4 |
| 2007/0256226 | A1 * | 11/2007 | Pinizzotto | 4/420.4 |
| 2008/0091060 | A1 * | 4/2008 | Heilman | 600/38 |
| 2008/0134423 | A1 * | 6/2008 | Ding | 4/420.2 |
| 2008/0201836 | A1 * | 8/2008 | Yao | 4/420.4 |
| 2009/0025133 | A1 * | 1/2009 | Oh | 4/448 |
| 2010/0004612 | A1 * | 1/2010 | Thevenin | 604/361 |
| 2010/0211021 | A1 * | 8/2010 | Wong | 604/247 |
| 2010/0242164 | A1 * | 9/2010 | Kwon et al. | 4/444 |
| 2010/0263117 | A1 * | 10/2010 | Rubin | 4/443 |
| 2010/0312199 | A1 * | 12/2010 | Lu | 604/279 |
| 2011/0016624 | A1 * | 1/2011 | Zeng | 4/420.2 |
| 2011/0041243 | A1 * | 2/2011 | Kwon | 4/443 |
| 2011/0179564 | A1 * | 7/2011 | Yao | 4/443 |
| 2011/0203044 | A1 * | 8/2011 | Lim | 4/447 |
| 2012/0005817 | A1 * | 1/2012 | Jeong et al. | 4/420.4 |

FOREIGN PATENT DOCUMENTS

| | | | |
|---|---|---|---|
| CN | 1347680 | A | 5/2002 |
| EP | 0615027 | | 8/1997 |
| JP | 58-173233 | A | 10/1983 |
| JP | 62-111038 | | 5/1987 |
| JP | 3-108352 | A | 5/1991 |
| JP | 2000301169 | A * | 10/2000 |
| JP | 2001193128 | A * | 7/2001 |
| JP | 2002180520 | A * | 6/2002 |
| KR | 1020050026322 | | 3/2005 |
| KR | 1020050052667 | | 6/2005 |
| WO | WO 2006132480 | A1 * | 12/2006 |
| WO | WO 2006135166 | A1 * | 12/2006 |
| WO | WO 2007007955 | A1 * | 1/2007 |
| WO | WO 2007064120 | A1 * | 6/2007 |

* cited by examiner

[Fig. 1]
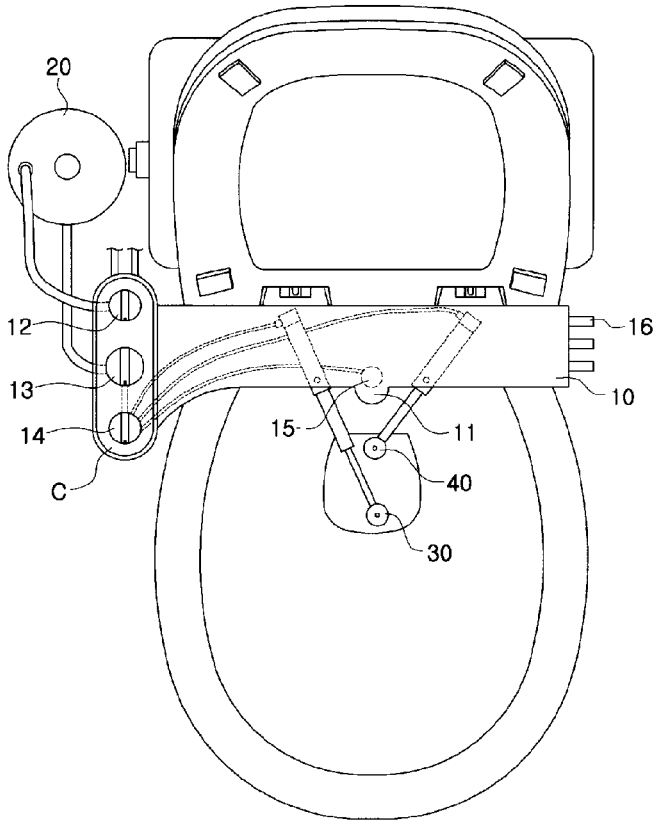
[Fig. 2]
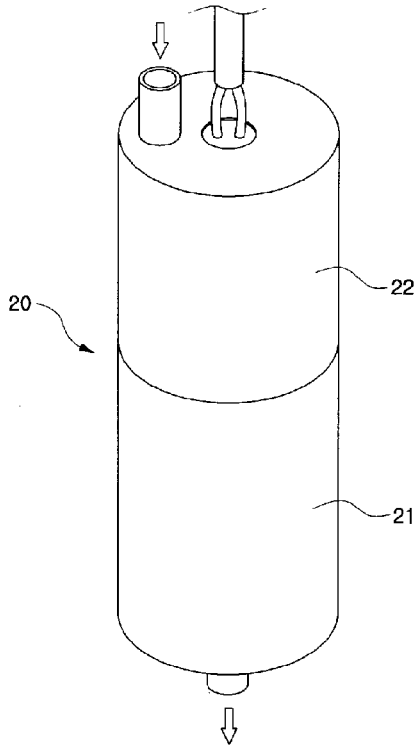

[Fig. 3]
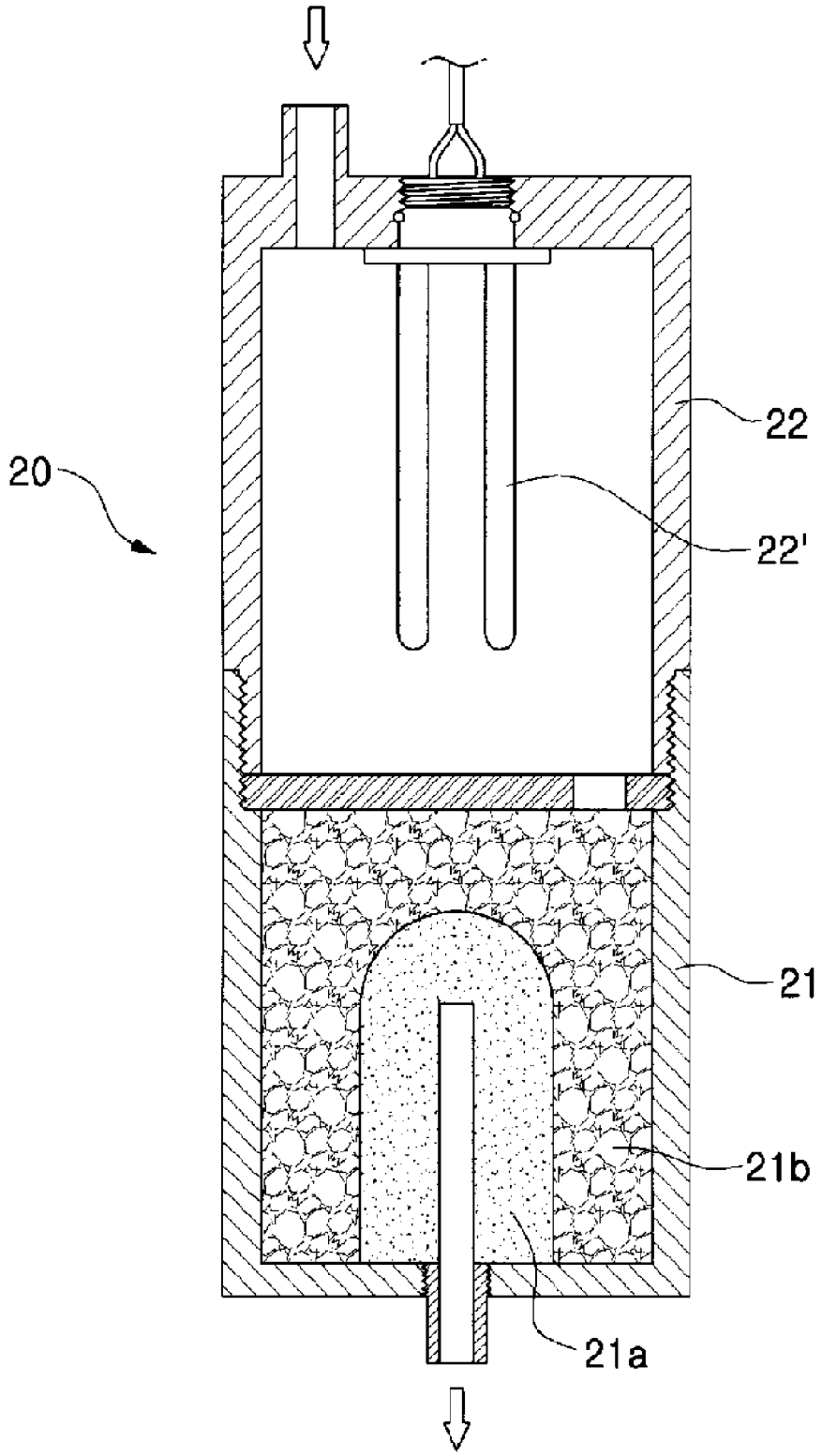

[Fig. 4]
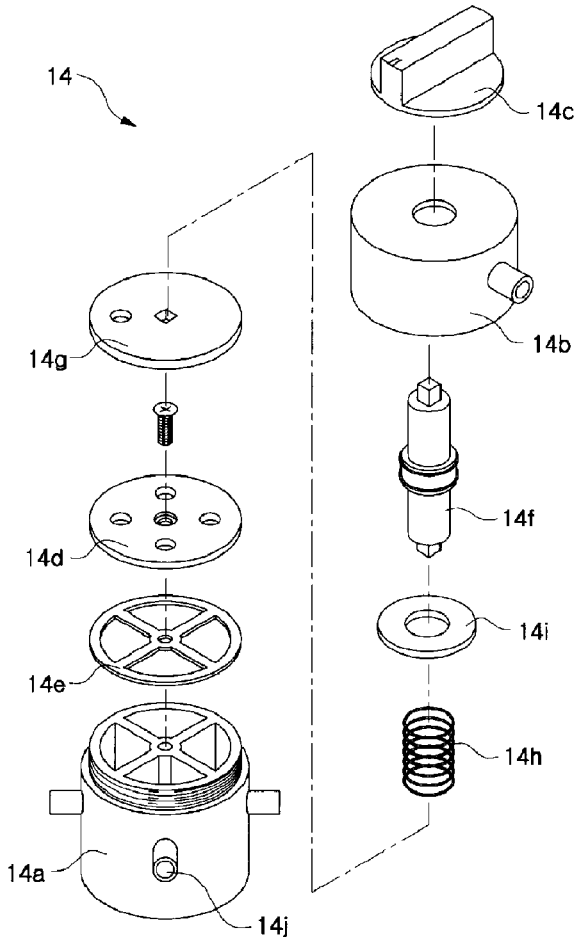
[Fig. 5]
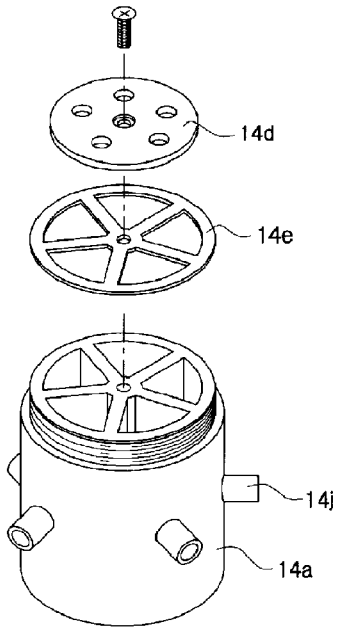

[Fig. 6]
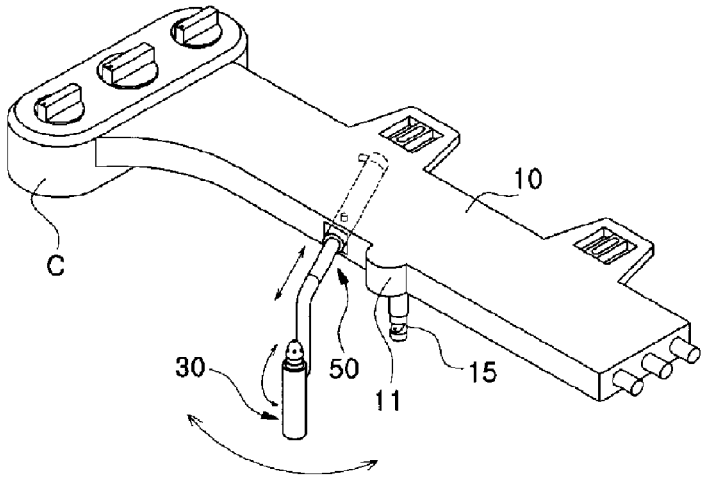
[Fig. 7]
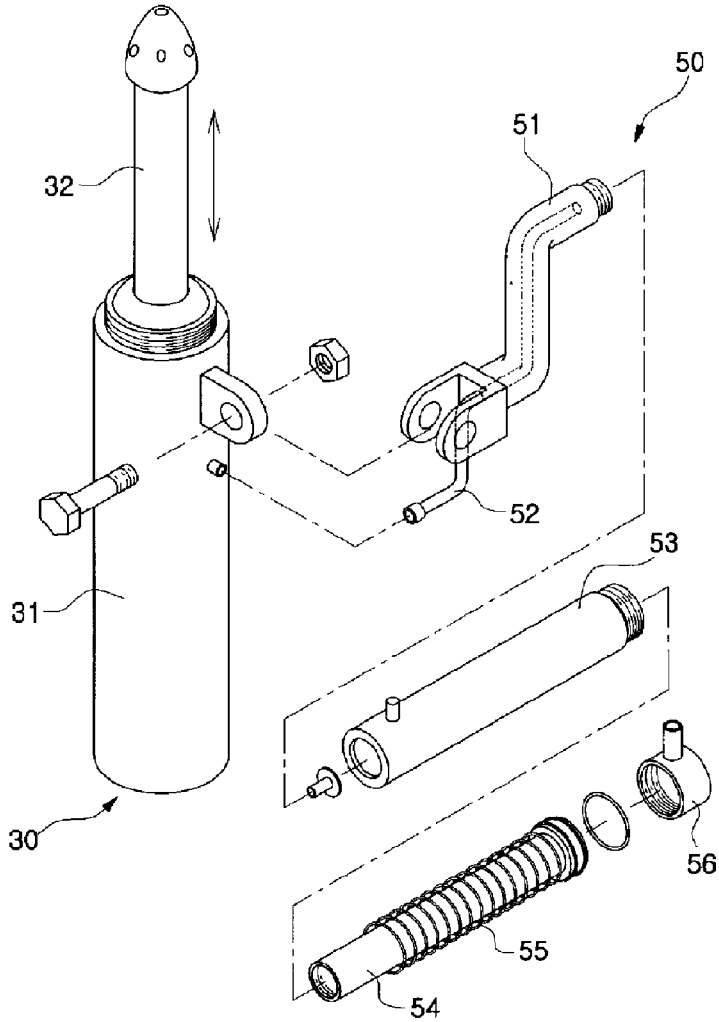

[Fig. 8]
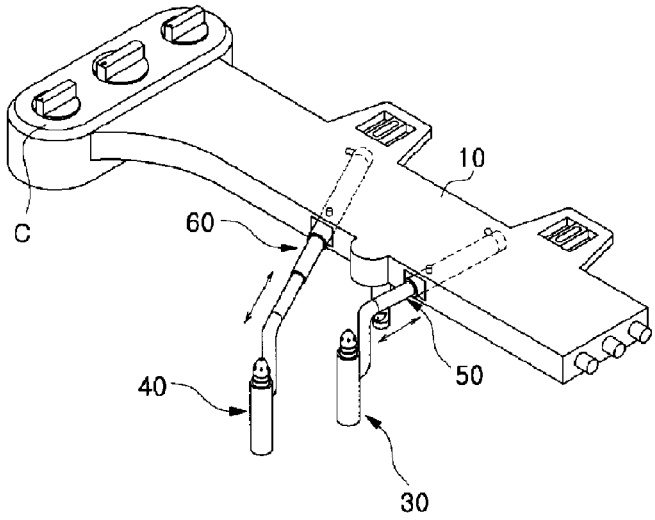
[Fig. 9]
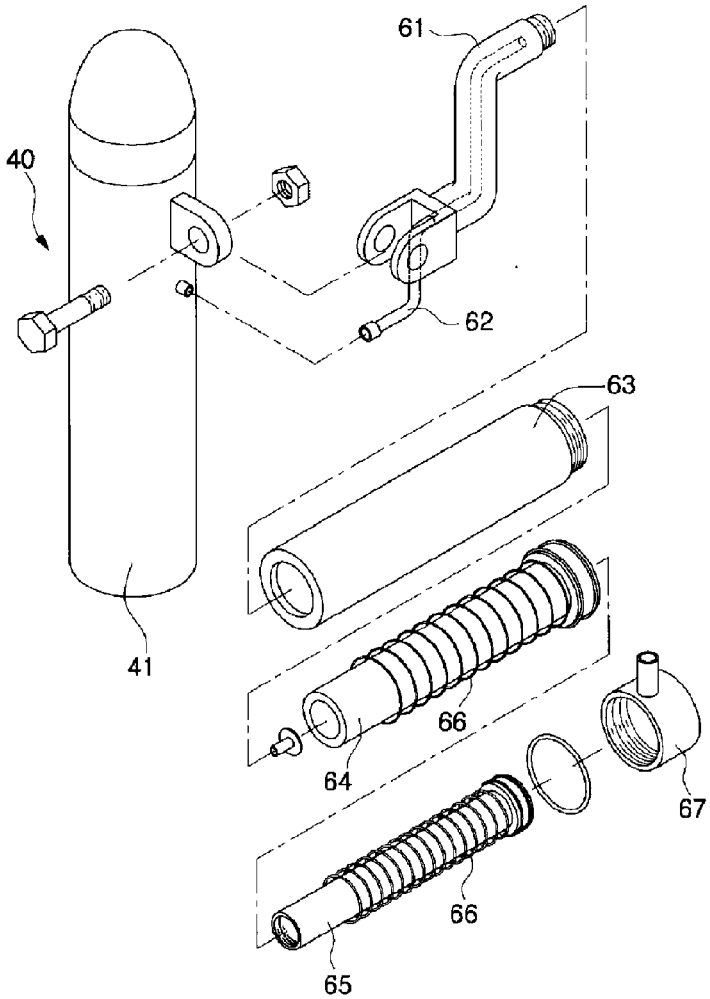

[Fig. 10]
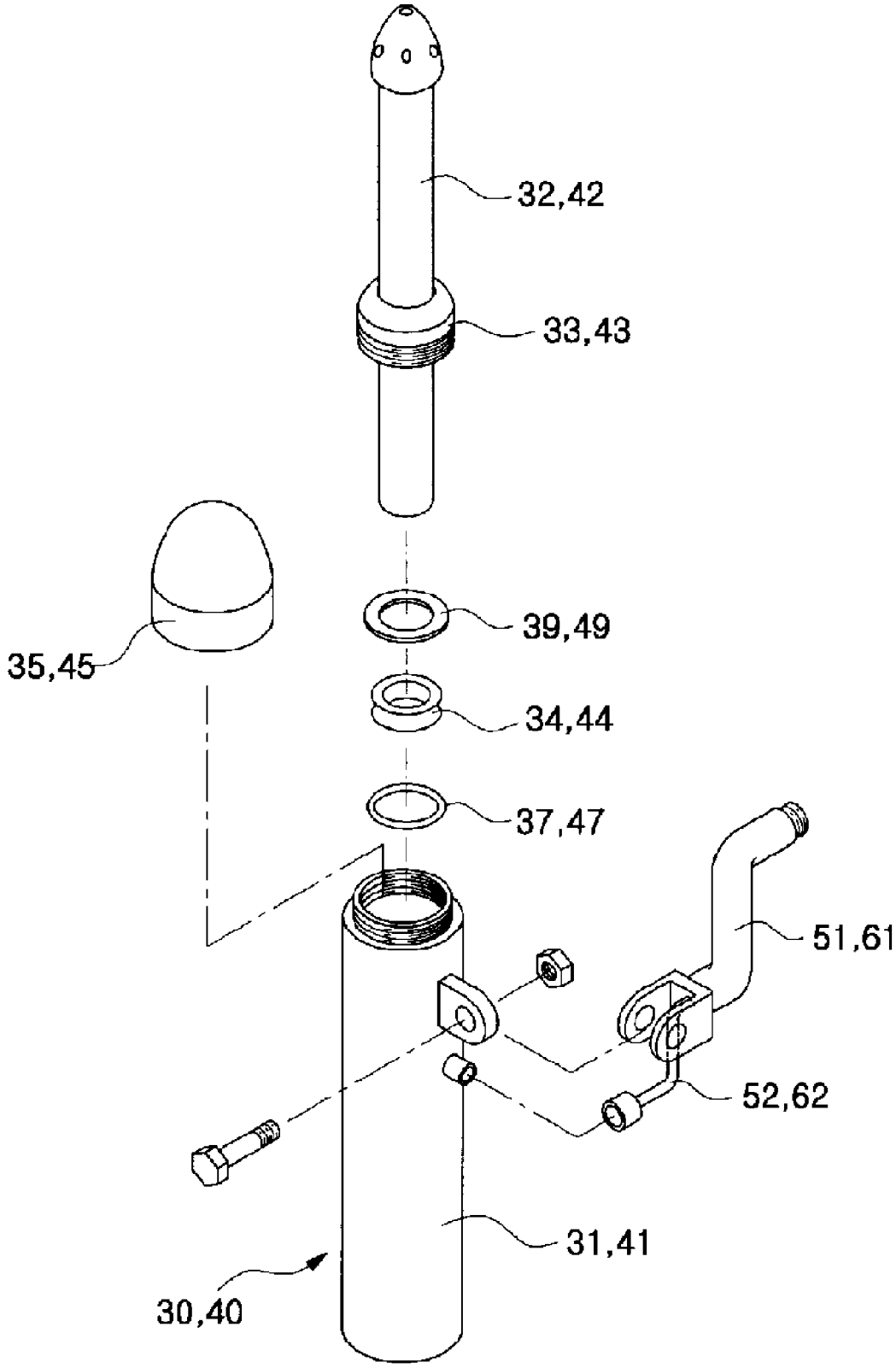

[Fig. 11]
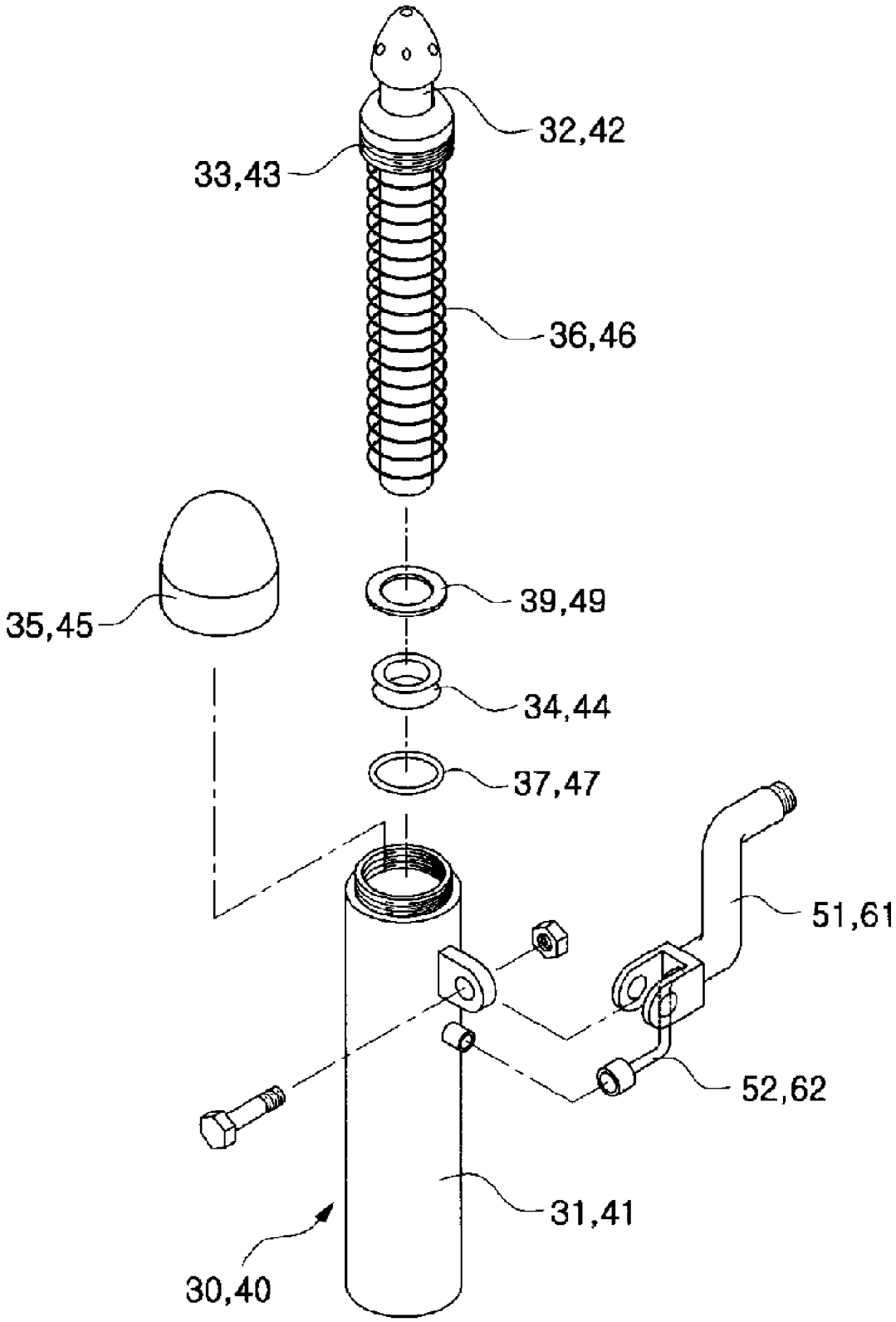

[Fig. 12]
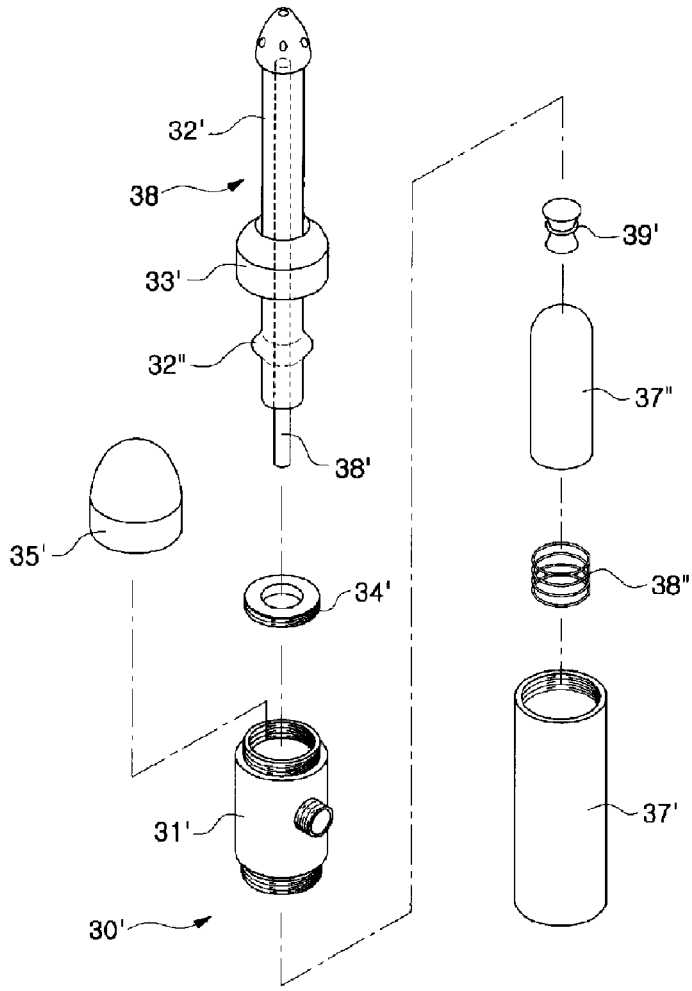
[Fig. 13]
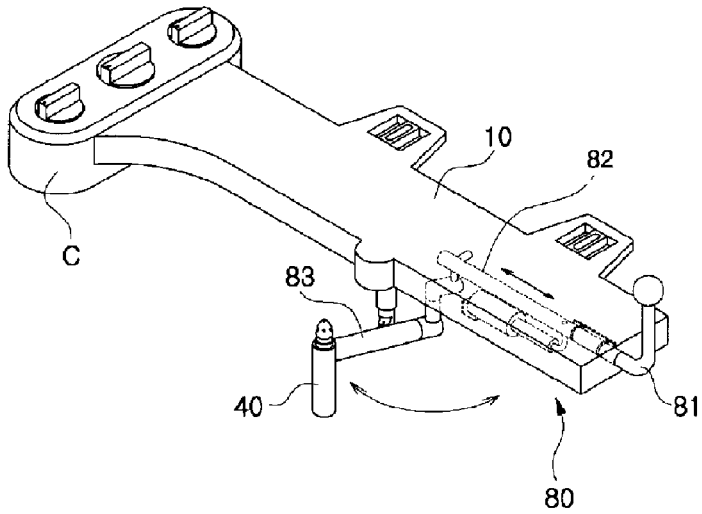

[Fig. 14]
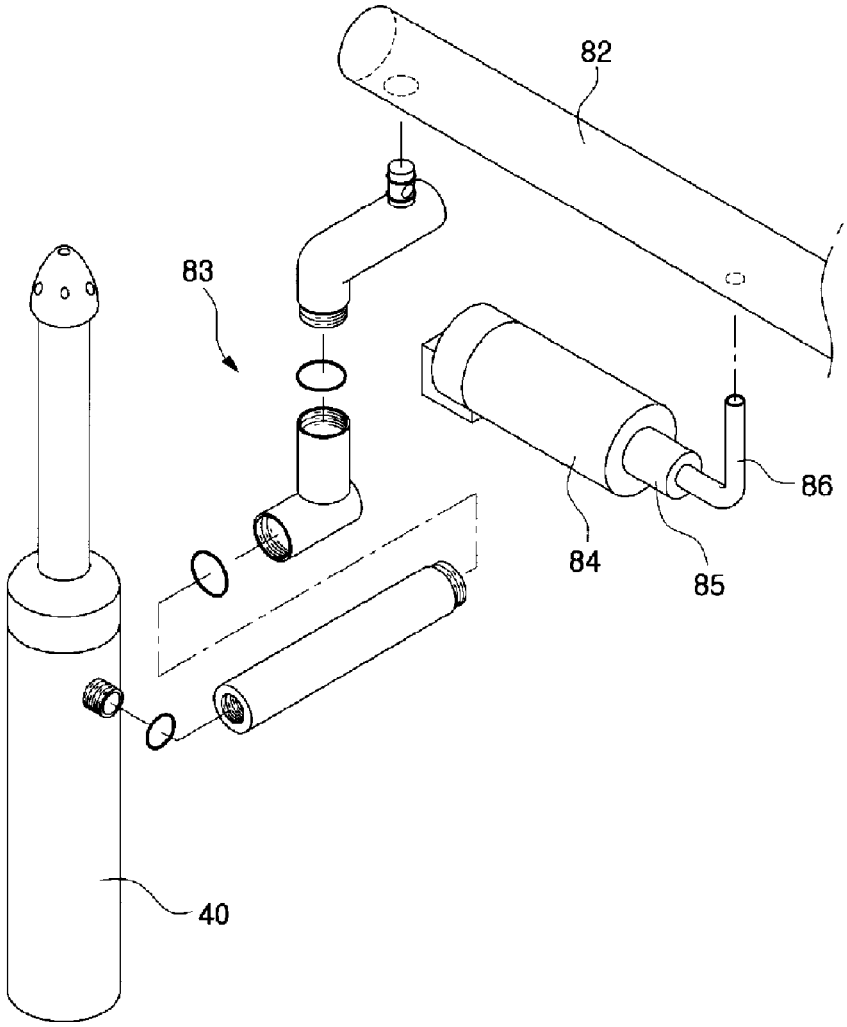
[Fig. 15]
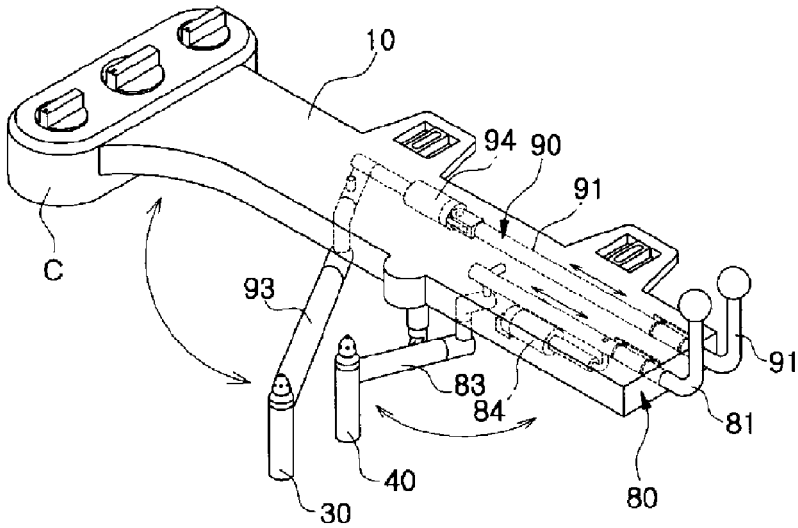

[Fig. 16]
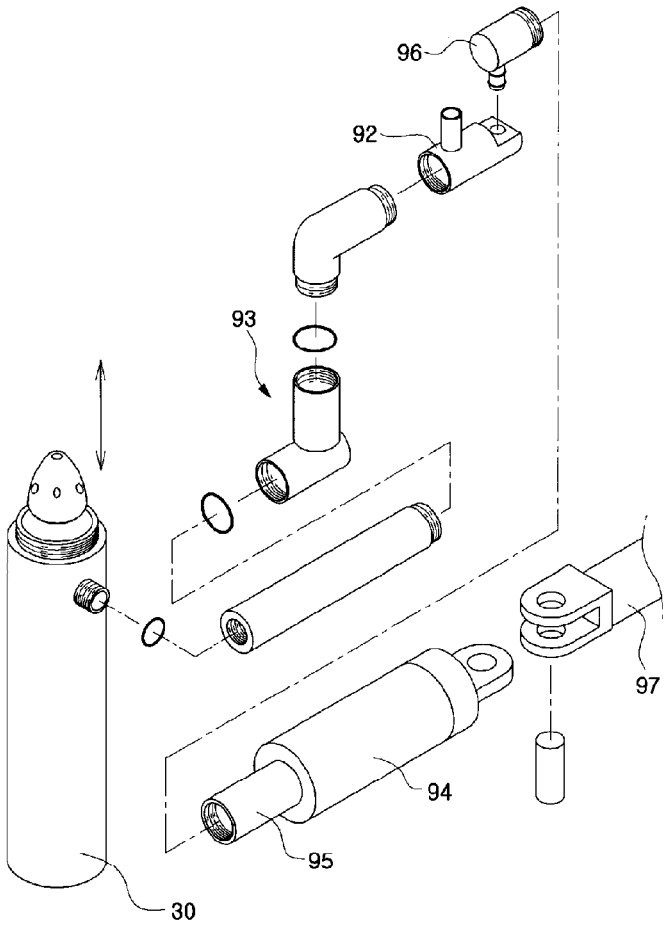
[Fig. 17]
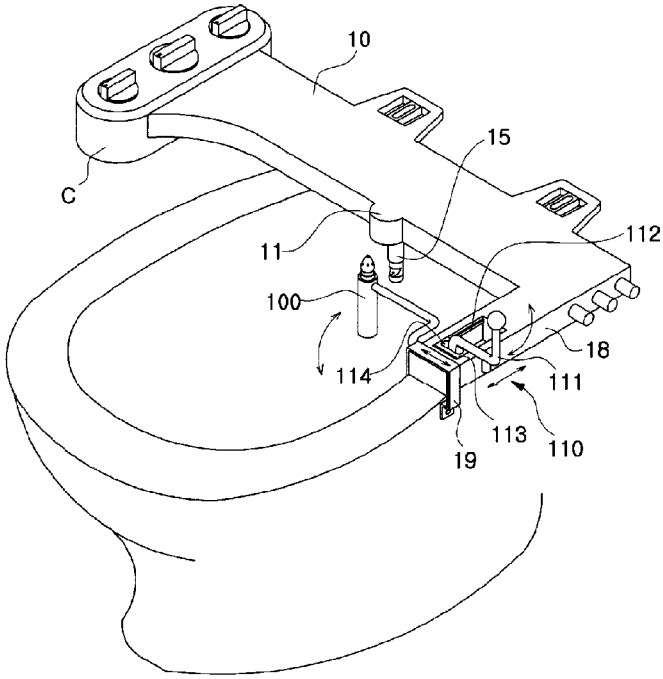

[Fig. 18]
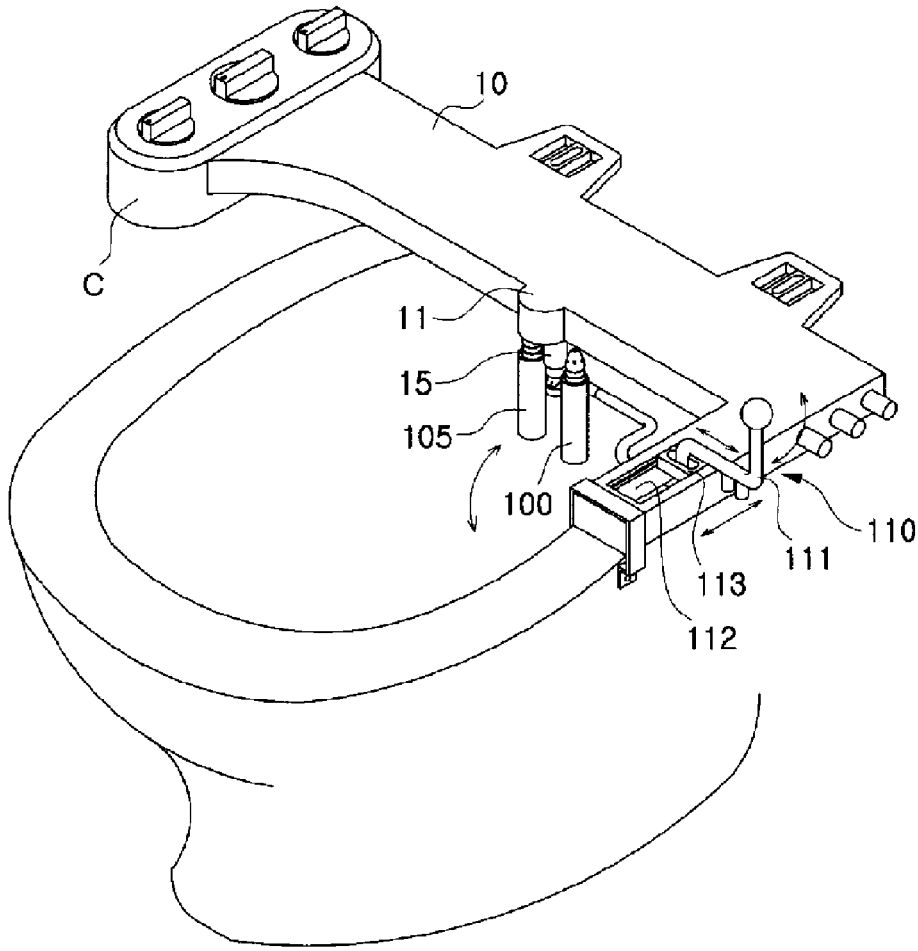
[Fig. 19]
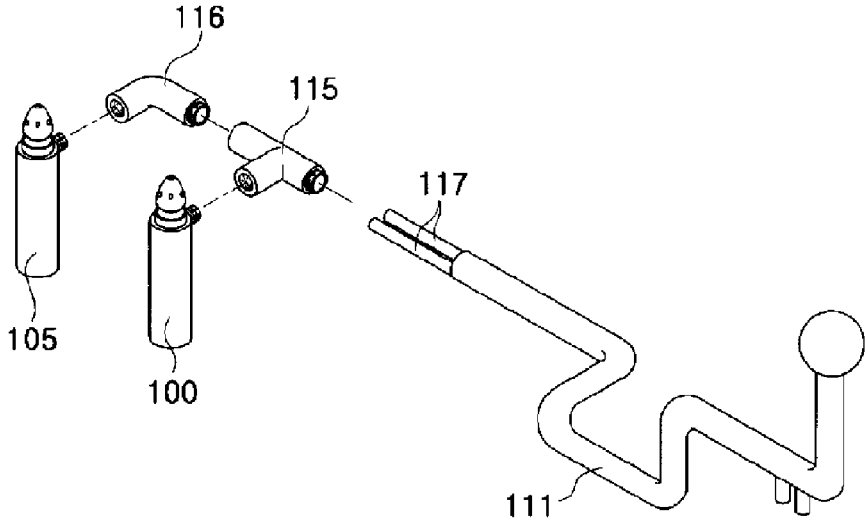

[Fig. 20]
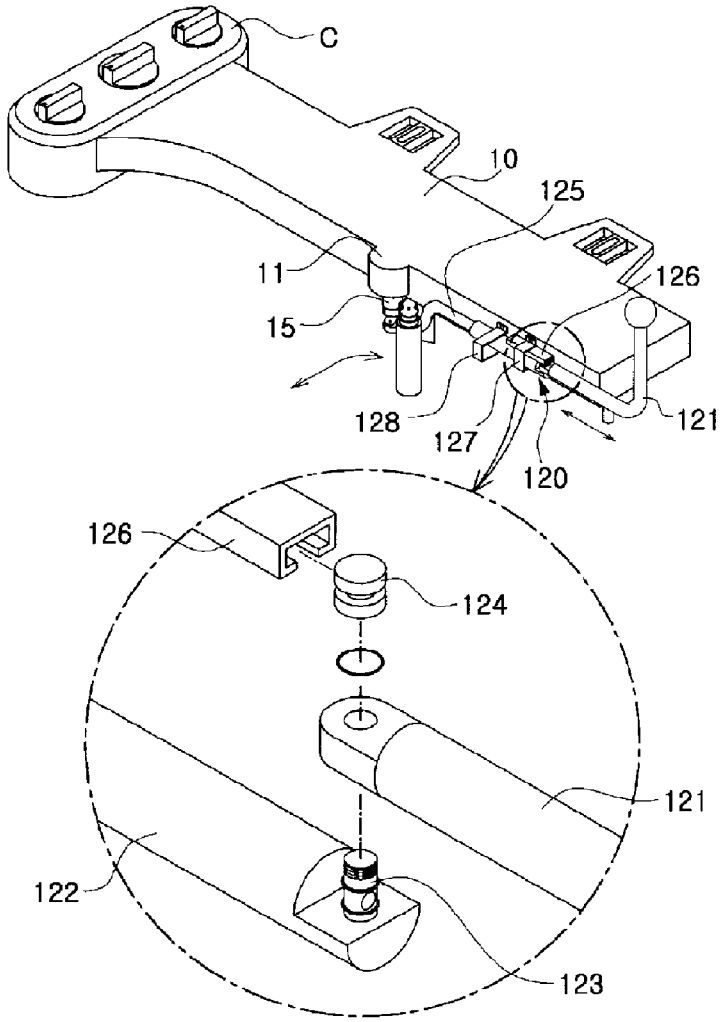
[Fig. 21]
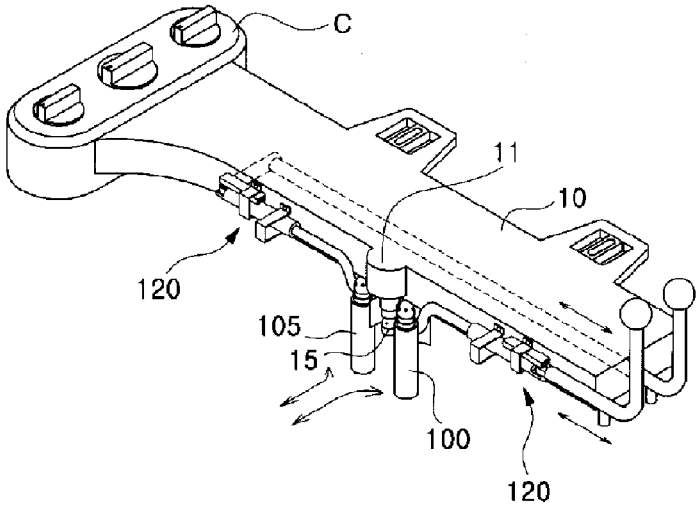

[Fig. 22]
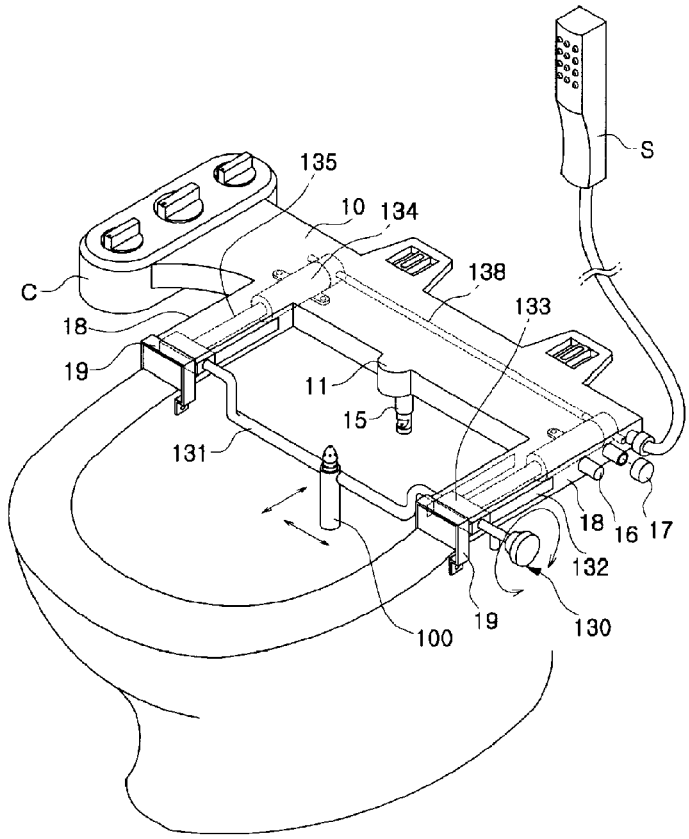
[Fig. 23]
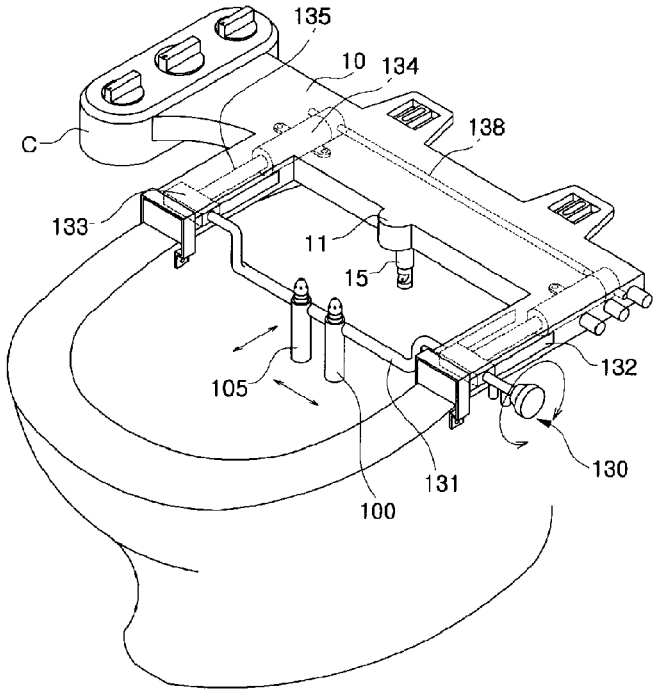

[Fig. 24]
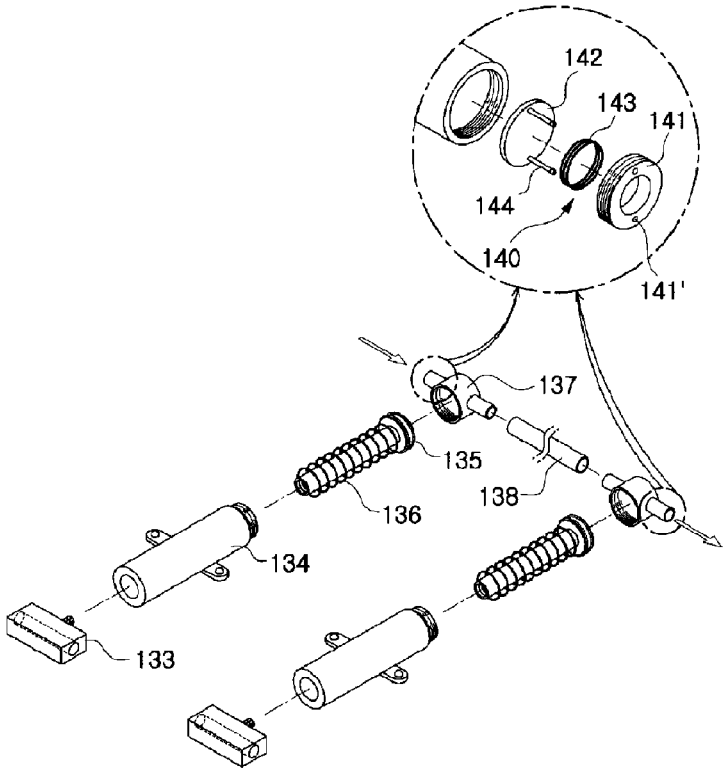
[Fig. 25]
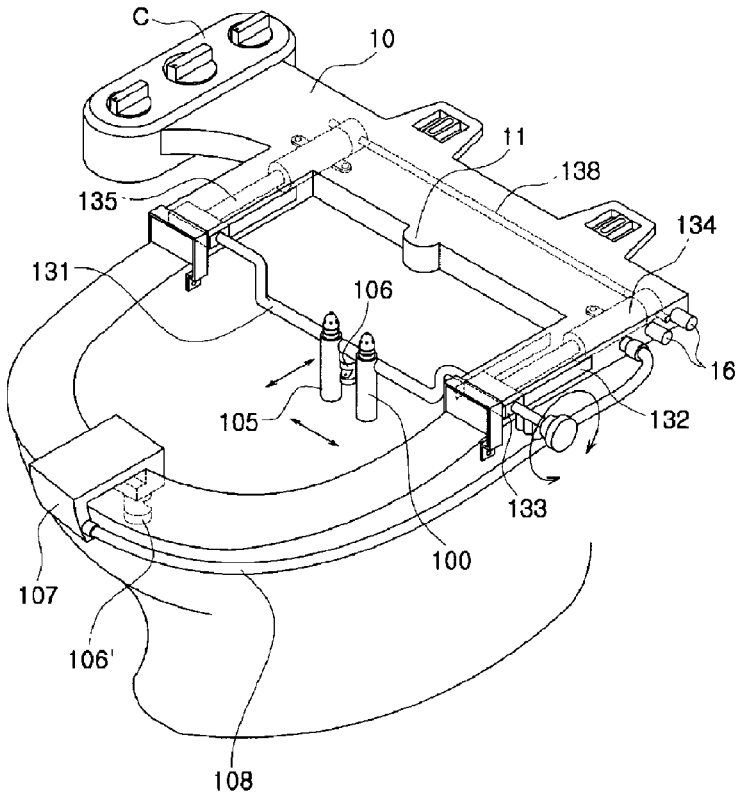

[Fig. 26]
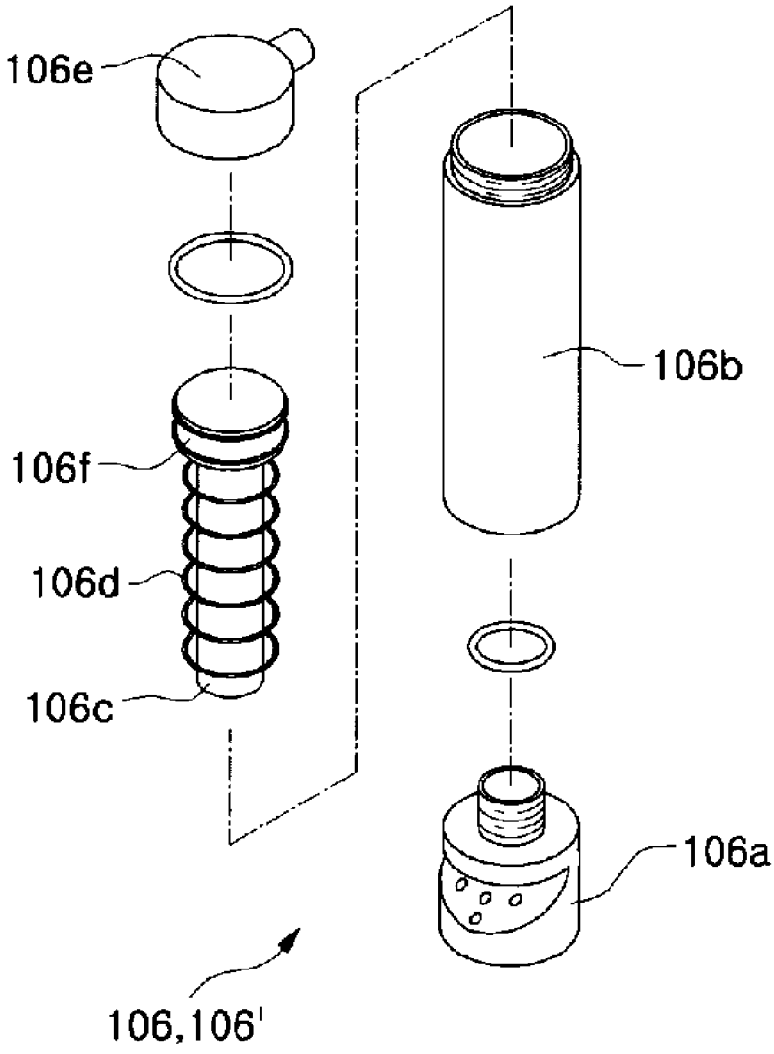

BIDET FOR TOILET BOWL

TECHNICAL FIELD

The present invention is directed to a bidet device mounted on a toilet bowl for cleansing an anus or the like and, more specifically, to a bidet device for toilet bowls that enables a user to cleanse the inner part of an intestine or a vagina through the use of an in-body wash bidet part.

BACKGROUND ART

As is generally known, a bidet device for toilet bowls is mounted on the rear portion of a toilet bowl and serves to cleanse an anus and a genital. Hygiene is taken serious in recent years and an increasing number of male persons as well as female persons tend to use the bidet device.

Conventional bidet devices are configured to violently spray or slowly eject water from the rear side of a toilet bowl and, therefore, can cleanse only the bodily parts exposed to the outside. Since no water can be supplied to inside an intestine or a vagina that requires a substantial degree of cleanliness, the conventional bidet devices are problematic in that they lack an ability to wash the intestine or the vagina.

DISCLOSURE OF INVENTION

Technical Problem

In view of the afore-mentioned problems inherent in the prior art, it is an object of the present invention to provide a bidet device for toilet bowls that can enable a user to insert an antimicrobial silicon hose into an intestine or a vagina to thereby conduct in-body wash and can also purify water to allow the user to perform the in-body wash with clean water.

Another object of the present invention is to provide a bidet device for toilet bowls that enables a user to adjust the position and angle of an in-body wash bidet part for cleansing an intestine or a vagina, thereby enhancing the convenience in using the bidet device.

Technical Solution

With these objects in view, one aspect of the present invention is directed to a bidet device for toilet bowls comprising: a main body mounted on a rear side of a toilet bowl and having a control part at one side; a main wash bidet part provided below a center protrusion of the main body for spraying water to cleanse posterior areas of a user; at least one in-body wash bidet part attached to the main body for cleansing one of an intestine and a vagina; a purifier part for purifying the water ejected through the main wash bidet part and the in-body wash bidet part; and a water ejection regulator part provided on the control part for selectively supplying the water to one of the main wash bidet part and the in-body wash bidet part.

According to the bidet device for toilet bowls of the present invention, the purifier part is preferably positioned between a temperature control section and a water pressure control section of the control part and includes a filter section comprised of a primary filter for first filtering the water introduced from the temperature control section and an activated carbon filter for enclosing the primary filter to adsorb contaminants of the first filtered water and a sterilizer section provided above the filter section and having a sterilizer for sterilizing the water prior to being supplied to the water pressure control section.

According to the bidet device for toilet bowls of the present invention, the water ejection regulator part includes a body having a plurality of internal compartments and a plurality of water outlet ports provided in an one-to-one relationship with the compartments, a distributor plate coupled to an upper side of the body through a packing and having a plurality of holes corresponding to the compartments of the body, a rotary plate rotatably positioned above the distributor plate and having an aperture for communication with one of the holes of the a distributor plate, a cover having a water inlet port and threadedly coupled to the body, a connector penetrating through a hole formed on a top end of the cover, the connector having a top end combined with an operating knob and a bottom end combined with the rotary plate, a spring insertedly fitted to a lower extension of the connector for pressing the rotary plate against the distributor plate, and a spring seat coupled to the connector for supporting the spring.

According to the bidet device for toilet bowls of the present invention, the main body includes a plurality of water outlet pipes connected to the water outlet ports of the water ejection regulator part, the water outlet ports and the water outlet pipes are provided in a greater number than the actual number of the bidet parts, and the water outlet pipe not in use is closed off by means of a pipe cap.

According to the bidet device for toilet bowls of the present invention, a position adjustor may be further provided for adjusting the position of the in-body wash bidet part, if needed. The position adjustor is adapted to conceal the in-body wash bidet part under the main body or taking out the in-body wash bidet part to the outside and allows the user to displace the in-body wash bidet part forward and backward. The in-body wash bidet part is preferably mounted on a tip end of the position adjustor in a rotatable manner.

According to the bidet device for toilet bowls of the present invention, the in-body wash bidet part includes a bidet body spaced apart from the main body by a pre-determined interval and supplied with the water through the position adjustor, an antimicrobial silicon hose extendible from the bidet body for insertion into the intestine or the vagina, a water ejection mouth cap coupled to a tip end of the bidet body, through a sealing member inserted around the antimicrobial silicon hose, for supporting the antimicrobial silicon hose on the bidet body, a stopper member fixed to a base end of the antimicrobial silicon hose for preventing removal of the antimicrobial silicon hose from the water ejection mouth cap, and a fixture ring fitted to the stopper member from around the antimicrobial silicon hose for retaining the stopper member in place.

The in-body wash bidet part may further include a spring insertedly fitted around the antimicrobial silicon hose and retained in place by the stopper member for returning the antimicrobial silicon hose to an initial position and a body cap coupled to a tip end of the bidet body for concealing the antimicrobial silicon hose.

According to the bidet device for toilet bowls of the present invention, the in-body wash bidet part includes a bidet body spaced apart from the main body by a pre-determined interval and supplied with the water through the position adjustor, a vibrator enclosure threadedly engaged with a bottom end of the bidet body and having a vibrator enclosed within the vibrator enclosure, a spring provided below the vibrator for absorbing the vibration of the vibrator, a vibratory penetrator protruding from the bidet body for insertion into the intestine or the vagina and spraying the water undulated by the vibratory motion of the vibrator, a water ejection mouth cap insertedly fitted around the vibratory penetrator and coupled to the bidet body for supporting the vibratory penetrator, and a connector member provided on a top end of the vibrator for transmitting the vibration to the vibratory penetrator.

The vibratory penetrator includes an antimicrobial silicon hose extending from the bidet body and having a protrusion at a tip end, a vibration bar placed within the antimicrobial silicon hose and coupled at a base end to the connector member for causing undulatory motion to the water, and a support member coupled to the bidet body and engaged with the protrusion for inhibiting the antimicrobial silicon hose from falling into the bidet body.

The vibratory penetrator is detachably attached to the bidet body. There is further provided a bidet cap that can be coupled to the bidet body when the vibratory penetrator is detached from the bidet body.

According to the bidet device for toilet bowls of the present invention, the in-body wash bidet part is provided in a single number at a position spaced apart from the main body by a predetermined distance. The position adjustor mounted on the main body is connected to the in-body wash bidet part so that it can displace the in-body wash bidet part in a front-rear direction or rotate the same within a given extent. Furthermore, the position adjustor allows the water to be supplied to the in-body wash bidet part therethrough. Preferably, the in-body wash bidet part is so combined as to swing within a prescribed extent with respect to the position adjustor.

According to the bidet device for toilet bowls of the present invention, the in-body wash bidet part includes a first in-body wash bidet part having an antimicrobial silicon hose for insertion into one of an intestine or a vagina of the user, a second in-body wash bidet part having an antimicrobial silicon hose for insertion into the other of the intestine or the vagina, a first position adjustor for adjusting the position of the first in-body wash bidet part, and a second position adjustor for adjusting the position of the second in-body wash bidet part.

The first position adjustor includes a support member rotatably supporting a bidet body with an antimicrobial silicon hose and having an internally arranged water guide pipe, a cylinder rotatably attached to the main body, a piston member positioned inside the cylinder and coupled to the support member for forward and backward movement under the action of a water pressure, a spring member insertedly fitted to the piston member for returning the piston member into an initial position when the water pressure is weakened, and a cylinder cap coupled to a rear end of the cylinder and having a water inlet port.

The second position adjustor has a multiple-stage telescopic structure such that the second in-body wash bidet part can be positioned more frontward than the first in-body wash bidet part. The second position adjustor includes a support member rotatably supporting a bidet body with an antimicrobial silicon hose and having an internally arranged water guide pipe, a cylinder rotatably attached to the main body, a piston cylinder positioned inside the cylinder for forward and backward movement under the action of a water pressure, a piston member positioned inside the piston cylinder and coupled to the support member for forward and backward movement under the action of the water pressure, spring members insertedly fitted to the piston cylinder and the piston member for returning the piston cylinder and the piston member into initial positions when the water pressure is weakened, and a cylinder cap coupled to a rear end of the cylinder and having a water inlet port.

According to the bidet device for toilet bowls of the present invention, there is further provided a rotation means for concealing the in-body wash bidet part under the main body or taking out the in-body wash bidet part to the outside. Preferably, the rotation means is selected from the group consisting of a manual type in which a user directly adjusts the position of the in-body wash bidet part by use of a handle, an automatic type in which the position of the in-body wash bidet part is automatically adjusted in response to the supply of the water and the combination type in which the manual type and the automatic type are used in common.

According to the bidet device for toilet bowls of the present invention, the in-body wash bidet part includes a first in-body wash bidet part whose antimicrobial silicon hose can be inserted into one of the intestine and the vagina and a second in-body wash bidet part whose antimicrobial silicon hose can be inserted into the other of the intestine and the vagina. The bidet device for toilet bowls further includes a first rotation means for rotating the second in-body wash bidet part and a second rotation means for rotating the first in-body wash bidet part.

The first rotation means includes a water guide pipeline hingedly secured to the second in-body wash bidet part for supplying the water to the second in-body wash bidet part with an antimicrobial silicon hose, a distributor pipe communicating with the water guide pipeline and connected to the handle for forward and backward movement, and a piston member positioned inside a cylinder, which in turn is affixed to the main body, and adapted to move forward and backward by the water supplied to the distributor pipe through a water inlet pipe, to thereby displace the distributor pipe.

The second rotation means includes a water guide pipeline hingedly secured to the first in-body wash bidet part for supplying the water to the first in-body wash bidet part with an antimicrobial silicon hose, a distributor pipe having a water inlet port and remaining coupled with the water guide pipeline, a piston member adapted to move forward and backward within a cylinder, a piston cap coupled to the piston member and kept in communication with the distributor pipe, and a rod interconnecting the cylinder and the handle.

A spring may be insertedly fitted to around the piston member so that the spring can return the piston member to an initial position when the water is not supplied.

Another aspect of the present invention is directed to a bidet device for toilet bowls comprising: a main body mounted on a rear side of a toilet bowl and having a control part at one side, the main body provided with an extension portion protruding a pre-determined extent in a front direction of the toilet bowl at an opposite position from the control part; a fixing member provided at a terminal end of the extension portion of the main body for affixing the extension portion to the toilet bowl; a main wash bidet part provided below a center protrusion of the main body for spraying water to cleanse posterior areas of a user; at least one in-body wash bidet part attached to the main body for cleansing one of an intestine and a vagina; and a position adjustor provided on the extension portion of the main body for adjusting the position of the in-body wash bidet part and for supplying the water to the in-body wash bidet part.

The position adjustor includes a handgrip of a repeatedly bent shape, one end of which protrudes upwardly from the extension portion and the other end of which is connected to the in-body wash bidet part, the handgrip having a water guide pipe formed inside the handgrip to communicate with the in-body wash bidet part, and a guide portion provided on the extension portion of the main body for guiding the movement of the handgrip. The guide portion is comprised of a guide groove formed on the extension portion of the main body in a front-rear direction of the toilet bowl and a guide block fitted to the guide groove for forward and backward movement along the guide groove, the guide block having a slot through which the handgrip passes.

According to the bidet device for toilet bowls of the present invention, the in-body wash bidet part includes a first in-body wash bidet part and a second in-body wash bidet part spaced apart from each other by a predetermined distance. The water guide pipe formed in the handgrip is also provided in dual numbers, one of which communicates with the first in-body wash bidet part and the other of which is in communication with the second in-body wash bidet part.

The guide block is adapted to be displaced forward and backward along the guide groove by means of a cylinder member operable when the water is supplied to the in-body wash bidet part.

A further aspect of the present invention is directed to a bidet device for toilet bowls comprising: a main body mounted on a rear side of a toilet bowl and having a control part at one side; a main wash bidet part provided below a center protrusion of the main body for spraying water to cleanse posterior areas of a user; at least one in-body wash bidet part attached to the main body for cleansing one of an intestine and a vagina; a handgrip part movable in a left-right direction along the main body and having a water guide passage formed inside the handgrip part; a water feeding pipe for allowing the handgrip part to communicate with the in-body wash bidet part; and a guide member mounted on the main body for guiding the movement of the handgrip part.

The handgrip part includes a linear motion portion rectilinearly movable along the main body, a rotation portion coupled to the linear motion portion for rotational movement within a predetermined extent, the water feeding pipe connected to the rotation portion, a connector portion provided between and interconnecting the linear motion portion and the rotation portion, and a guide cap coupled to a top end of the connector portion through a tip end of the linear motion portion.

The guide member includes a guide block coupled to the guide cap for guiding linear movement of the linear motion portion, a first stopper mounted on the main body in such a manner as to enclose the guide block and the rotation portion and adapted to restrain rotational movement of the rotation portion to a predetermined extent, and a second stopper provided closer to the center of the main body than the first stopper is and formed in a larger size than the first stopper.

The in-body wash bidet part includes a first in-body wash bidet part positioned at one side of the main wash bidet part and a second in-body wash bidet part lying in an opposing relationship with the first in-body wash bidet part. The bidet device for toilet bowls may further comprise a cylinder member for allowing the water to be selectively supplied to one of the first in-body wash bidet part and the second in-body wash bidet part, the cylinder member adapted to displace the handgrip part forward and backward when the water is supplied to the first in-body wash bidet part and the second in-body wash bidet part.

A still further aspect of the present invention is directed to a bidet device for toilet bowls comprising: a main body mounted on a rear side of a toilet bowl and having a control part at one side, the main body provided with two extension portions protruding frontward a predetermined extent along side portions of the toilet bowl; fixing members respectively provided at a terminal end of each of the extension portions of the main body for affixing the extension portions to the toilet bowl; a main wash bidet part provided below a center protrusion of the main body for spraying water to cleanse posterior areas of a user; at least one in-body wash bidet part attached to the main body for cleansing one of an intestine and a vagina; and a position adjustor for adjusting the position and angle of the in-body wash bidet part.

The position adjustor includes a handgrip mounted on the extension portions of the main body across the toilet bowl and having a water guide passage formed inside the handgrip, a pair of guide blocks movable forward and backward along guide grooves respectively formed on the extension portions, the handgrip adapted to pass through the guide blocks, and a pair of cylinder members for displacing the guide blocks forward and backward depending on the supply of water.

Each of the cylinder members includes a cylinder provided at a rear side of each of the extension portions of the main body, a piston fitted into the cylinder and coupled at a tip end to each of the guide blocks, a spring insertedly fitted to around the piston for displacing the piston backward and returning each of the guide blocks into an initial position at the time when the water supply is cut off, and a cylinder cap threadedly coupled to a rear end of the cylinder and having a water inlet port and a water outlet port.

The cylinder caps of the respective cylinder members are connected to each other by means of a water guide pipe and are provided with check valves at a water inlet port and a water outlet port to which the water guide pipe is not connected. Each of the check valves includes a support member threadedly coupled to each of the water inlet port and the water outlet port of the cylinder caps and having a bore formed at a center of the support member, a blocking plate for closing off the bore of the support member to interrupt the flow of water, the blocking plate having an outer diameter smaller than that of the water inlet port and the water outlet port, a pair of guide bars formed on the blocking plate and inserted into guide holes of the support member, each of the guide bars having a tip end bent in such a manner as to prevent removal from the support member, and a spring retained between the support member and the blocking plate.

Preferably, the handgrip is curved such that the in-body wash bidet part can be placed a predetermined distance below a top end of the toilet bowl and has opposite straight portions of a predetermined length extending through the guide blocks for movement in a left-right direction.

The in-body wash bidet part includes a first in-body wash bidet part and a second in-body wash bidet part symmetrically spaced apart from each other about the main wash bidet part. The water guide passage is also provided in dual numbers, one of which communicates with the first in-body wash bidet part and the other of which is in communication with the second in-body wash bidet part.

The main wash bidet part is provided between the first in-body wash bidet part and the second in-body wash bidet part. The handgrip has three water guide passages respectively communicating with the main wash bidet part, the first in-body wash bidet part and the second in-body wash bidet part. The bidet device for toilet bowls may further include a front bidet part positioned at a front side of the toilet bowl and affixed in place by means of a fixing member for spraying the water supplied through a connector hose.

Each of the main wash bidet part and the front bidet part includes a nozzle for spraying the water, a cylinder having an internally formed guide groove, a piston fitted for communication with the nozzle and movable within the cylinder in a front-rear direction, the piston having a protrusion inserted into the guide groove of the cylinder, a spring fitted to around the piston for returning the piston to an initial position, and a cylinder cap coupled to the cylinder and having a water inlet port.

The above and other objects and features of the present invention will become apparent from the following description of preferred embodiments, given in conjunction with the accompanying drawings. The terms and words used herein are adopted by the inventor(s) in an effort to best describe his or her invention and should be construed in the meaning and concept that conforms to the technical idea of the present invention.

Advantageous Effects

One effect provided by the present invention noted above is that the purified and sterilized water can be sprayed through the in-body wash bidet part into an intestine or a vagina for the sake of in-body wash, thereby allowing a female user to enjoy increased cleanliness and improving the convenience in use.

Another effect provided by the present invention is that the water can be supplied to a plurality of bidet parts through the water ejection regulator part and an external device can be connected to a water ejection pipe not in use, thus expanding the usage of the bidet device for toilet bowls.

A further effect provided by the present invention is that the antimicrobial silicon hose of the in-body wash bidet part can be inserted into the intestine or the vagina to thereby perform in-body wash with ease and the use of the vibration type in-body wash bidet part can transform the water of abnormal molecular bond into a normal one, thereby beneficially affecting the body of a user.

A still further effect provided by the present invention is that the position and angle of the in-body wash bidet part can be adjusted by use of a variety of position adjustors, thereby enhancing the convenience in use.

BRIEF DESCRIPTION OF THE DRAWINGS

FIG. 1 is a top view showing a bidet device for toilet bowls in accordance with the present invention;

FIG. 2 is a perspective view illustrating a purifier part, one of major elements of the present invention;

FIG. 3 is a cross-sectional view depicting the purifier part shown in FIG. 2;

FIG. 4 is an exploded perspective view showing a water ejection regulator part, one of major elements of the present invention;

FIG. 5 is an exploded perspective view illustrating another example of the water ejection regulator part;

FIG. 6 is a perspective view showing a bidet device for toilet bowls in accordance with a first embodiment of the present invention;

FIG. 7 is an exploded perspective view illustrating a first position adjustor, one of major elements of the bidet device in accordance with the first embodiment;

FIG. 8 is a perspective view showing a bidet device for toilet bowls in accordance with a second embodiment of the present invention;

FIG. 9 is an exploded perspective view illustrating a second position adjustor, one of major elements of the bidet device in accordance with the second embodiment;

FIG. 10 is an exploded perspective view illustrating a first example of an in-body wash bidet part, one of major elements of the present invention;

FIG. 11 is an exploded perspective view illustrating a second example of the in-body wash bidet part, one of major elements of the present invention;

FIG. 12 is an exploded perspective view illustrating a third example of the in-body wash bidet part, one of major elements of the present invention;

FIG. 13 is a perspective view showing a bidet device for toilet bowls in accordance with a third embodiment of the present invention;

FIG. 14 is an exploded perspective view illustrating a first rotation means, one of major elements of the bidet device in accordance with the third embodiment;

FIG. 15 is a perspective view showing a bidet device for toilet bowls in accordance with a fourth embodiment of the present invention;

FIG. 16 an exploded perspective view illustrating a second rotation means, one of major elements of the bidet device in accordance with the fourth embodiment;

FIG. 17 is a perspective view showing a bidet device for toilet bowls in accordance with a fifth embodiment of the present invention;

FIG. 18 is a perspective view showing a bidet device for toilet bowls in accordance with a sixth embodiment of the present invention;

FIG. 19 is an exploded perspective view illustrating a handgrip part, one of major elements of the bidet device in accordance with the sixth embodiment;

FIG. 20 is a perspective view showing a bidet device for toilet bowls in accordance with a seventh embodiment of the present invention;

FIG. 21 is a perspective view showing a bidet device for toilet bowls in accordance with an eighth embodiment of the present invention;

FIG. 22 is a perspective view showing a bidet device for toilet bowls in accordance with a ninth embodiment of the present invention;

FIG. 23 is a perspective view showing a bidet device for toilet bowls in accordance with a tenth embodiment of the present invention;

FIG. 24 is an exploded perspective view illustrating a cylinder member, one of major elements of the bidet device in accordance with the tenth embodiment;

FIG. 25 is a perspective view showing a bidet device for toilet bowls in accordance with an eleventh embodiment of the present invention; and FIG. 26 is an exploded perspective view illustrating a main wash bidet part and a front bidet part, one of major elements of the bidet device in accordance with the eleventh embodiment.

BEST MODE FOR CARRYING OUT THE INVENTION

Preferred embodiments of a bidet device for toilet bowls according to the present invention will now be described in detail with reference to the accompanying drawings.

Mode for the Invention

FIG. 1 is a top view showing a bidet device for toilet bowls in accordance with the present invention. FIG. 2 is a perspective view illustrating a purifier part, one of major elements of the present invention. FIG. 3 is a cross-sectional view depicting the purifier part shown in FIG. 2. FIG. 4 is an exploded perspective view showing a water ejection regulator part, one of major elements of the present invention. FIG. 5 is an exploded perspective view illustrating another example of the water ejection regulator part.

A bidet device for toilet bowls of the present invention includes a main body 10 mounted on a rear side of a toilet bowl and having a control part C at one side, a main wash bidet part 15 provided below a center protrusion 11 of the main body 10 for spraying water to cleanse posterior areas of a user, at least one in-body wash bidet part 30 or 40 attached to the main body 10 for cleansing one of an intestine and a vagina, a purifier part 20 for purifying the water ejected through the main wash bidet part 15 and the in-body wash bidet part 30 or 40, and a water ejection regulator part 14 provided on the control part C for selectively supplying the water to one of the main wash bidet part 15 and the in-body wash bidet part 30 or 40.

In this regard, the purifier part 20 is positioned between a temperature control section 12 and a water pressure control section 13 of the control part C and includes a filter section 21 comprised of a primary filter 21 a for first filtering the water introduced from the temperature control section 12 and an activated carbon filter 21*b* for enclosing the primary filter 21*a* to adsorb contaminants of the first filtered water and a sterilizer section 22 provided above the filter section 21 and having a sterilizer 22 for sterilizing the water prior to being supplied to the water pressure control section 13.

The water ejection regulator part 14 includes a body 14*a* having a plurality of internal compartments and a plurality of water outlet ports 14*j* provided in an one-to-one relationship with the compartments, a distributor plate 14*d* coupled to an upper side of the body 14*a* through a packing 14*e* and having a plurality of holes corresponding to the compartments of the body 14*a*, a rotary plate 14*g* rotatably positioned above the distributor plate 14*d* and having an aperture for communication with one of the holes of the a distributor plate 14*d*, a cover 14*b* having a water inlet port and threadedly coupled to the body 14*a*, a connector 14*f* penetrating through a hole formed on a top end of the cover 14*b*, the connector 14*f* having a top end combined with an operating knob 14*c* and a bottom end combined with the rotary plate 14*g*, a spring 14*h* insertedly fitted to a lower extension of the connector 14*f* for pressing the rotary plate 14*g* against the distributor plate 14*d*, and a spring seat 14*i* coupled to the connector 14*f* for supporting the spring 14*h*.

The main body 10 includes a plurality of water outlet pipes 16 connected to the water outlet ports 14*j* of the water ejection regulator part 14. The water outlet ports 14*j* and the water outlet pipes 16 are provided in a greater number than the actual number of the bidet parts. The water outlet pipe 16 not in use is closed off by means of a pipe cap 17. The body 14*a* may have four internal compartments as illustrated in FIG. 4 or five internal compartments as depicted in FIG. 5.

The in-body wash bidet part 30 or 40 includes a position adjustor 50 or 60 that enables a user to adjust the position of the in-body wash bidet part 30 or 40 if needed. The position adjustor 50 or 60 allows the in-body wash bidet part 30 or 40 to be concealed under the main body 10 or protruded outwardly and to be moved forward or backward. The in-body wash bidet part 30 or 40 is rotatably attached to the tip end of the position adjustor 50 or 60.

The bidet device for toilet bowls of the present invention configured as described above is adapted to perform a typical bidet function and an in-body wash function by spraying the water purified in the water purifier through the main wash bidet part and the in-body wash bidet part.

The water supplied from an external water source is temperature-controlled in the temperature control section 12 and then purified as it passes through the purifier part 20. In other words, the water is filtered wile passing through the primary filter 21*a* and the activated carbon filter 21*b* and sterilized by the sterilizer 22. The water thus purified and sterilized is pressure-controlled in the water pressure control section 13, after which the direction of ejection of the water is decided in the water ejection regulator part 14. In the water ejection regulator part 14, the rotary plate 14*g* is rotated as the user turns the operating knob 14*c* and the water is ejected through one of the water outlet ports 14*j* when the aperture of the rotary plate 14*g* comes into alignment with one the holes of the distributor plate 14*d*.

The water ejected through one of the water outlet ports 14*j* is sprayed through the main wash bidet part 15 or the in-body wash bidet part 30 or 40 that remains in communication with the water outlet ports 14*j*. Also, the water may be supplied to an external device such as a shower device S or the like via the water outlet pipes 16 of the main body 10. The main body 10 serves to spray the water from the rear bottom side of the user to thereby wash an anus or other bodily parts, whereas the in-body wash bidet part 30 or 40 acts to perform in-body wash through the use of an antimicrobial silicon hose 32 or 42 that can be inserted into an intestine or a vagina of the user. Such a configuration is applied to all of the embodiments set forth below.

In this regard, the in-body wash bidet part 30 or 40 is normally positioned below the main body 10 and, when in use, is moved to the center of the toilet bowl. To this end, the position adjustor 50 or 60 mounted on the main body 10 is configured to rotate or displace the in-body wash bidet part 30 or 40 in a front-rear direction. Moreover, the in-body wash bidet part 30 or 40 is so combined as to swing within a given extent with respect to the position adjustor 50 or 60, thus allowing the user to adjust the angle of the in-body wash bidet part 30 or 40.

The position adjustor 50 or 60 will now be specifically described in the following. FIG. 6 is a perspective view showing a bidet device for toilet bowls in accordance with a first embodiment of the present invention. FIG. 7 is an exploded perspective view illustrating a first position adjustor, one of major elements of the bidet device in accordance with the first embodiment. FIG. 8 is a perspective view showing a bidet device for toilet bowls in accordance with a second embodiment of the present invention. FIG. 9 is an exploded perspective view illustrating a second position adjustor, one of major elements of the bidet device in accordance with the second embodiment.

According to the bidet device for toilet bowls of a first embodiment of the present invention, the in-body wash bidet part 30 is provided in a single number at a position spaced apart from the main body 10 by a predetermined distance. The position adjustor 50 mounted on the main body 10 is connected to the in-body wash bidet part 30 so that it can displace the in-body wash bidet part 30 in a front-rear direction or rotate the same within a given extent. Furthermore, the position adjustor 50 allows the water to be supplied to the in-body wash bidet part 30 therethrough. The in-body wash bidet part 30 is so combined as to swing within a prescribed extent with respect to the position adjustor 50.

The bidet device for toilet bowls of a second embodiment of the present invention has the same configuration as that of the first embodiment noted above, except that the in-body wash bidet part and the position adjustor are respectively provided in dual numbers.

In other words, according to the bidet device for toilet bowls of the second embodiment, the in-body wash bidet part includes a first in-body wash bidet part 30 having an antimicrobial silicon hose 32 for insertion into one of an intestine or a vagina of the user, a second in-body wash bidet part 40 having an antimicrobial silicon hose 42 for insertion into the other of the intestine or the vagina, a first position adjustor 50 for adjusting the position of the first in-body wash bidet part 30, and a second position adjustor 60 for adjusting the position of the second in-body wash bidet part 40.

The first position adjustor 50 includes a support member 51 rotatably supporting a bidet body 31 with an antimicrobial silicon hose 32 and having an internally arranged water guide pipe 52, a cylinder 53 rotatably attached to the main body 10, a piston member 54 positioned inside the cylinder 53 and coupled to the support member 51 for forward and backward movement under the action of a water pressure, a spring member 55 insertedly fitted to the piston member 54 for returning the piston member 54 into an initial position when the water pressure is weakened, and a cylinder cap 56 coupled to a rear end of the cylinder 53 and having a water inlet port.

The second position adjustor 60 has a multiple-stage telescopic structure such that the second in-body wash bidet part 40 can be positioned more frontward than the first in-body wash bidet part 30. The second position adjustor 60 includes a support member 61 rotatably supporting a bidet body 41 with an antimicrobial silicon hose 42 and having an internally arranged water guide pipe 62, a cylinder 63 rotatably attached to the main body 10, a piston cylinder 64 positioned inside the cylinder 63 for forward and backward movement under the action of a water pressure, a piston member 65 positioned inside the piston cylinder 64 and coupled to the support member 61 for forward and backward movement under the action of the water pressure, spring members 66 insertedly fitted to the piston cylinder 64 and the piston member 65 for returning the piston cylinder 64 and the piston member 65 into initial positions when the water pressure is weakened, and a cylinder cap 67 coupled to a rear end of the cylinder 63 and having a water inlet port.

According to the bidet devices for toilet bowls of the first and second embodiments of the present invention as configured above, the in-body wash bidet part 30 or 40 can be located at the center of the toilet bowl with a desired angle in the event that the water is supplied to the in-body wash bidet part 30 or 40.

As the water is supplied from the water ejection regulator part 14 to the in-body wash bidet part 30 or 40, the in-body wash bidet part 30 or 40 is moved forward, in which condition the user can rotate the in-body wash bidet part 30 or 40 into a proper position. This makes it possible for the user to bring the in-body wash bidet part 30 or 40 at the center of the toilet bowl. In addition, the user can rotate the in-body wash bidet part 30 or 40 with respect to the position adjustor 50 or 60 into a desired angular position.

The first in-body wash bidet part 30 positioned at the rear side in the drawings can be displaced forward or backward or can be rotated by means of the first position adjustor 50. In order for the water to reach the first in-body wash bidet part 30, the water is first supplied into the cylinder 53 to thereby move the piston member 54 forward, in response to which the first in-body wash bidet part 30 is caused to move forward to the center of the toilet bowl. At this moment, the first in-body wash bidet part 30 can be rotated by the user because the cylinder 53 remains rotatably mounted on the main body 10. Under the condition that the position of the first in-body wash bidet part 30 is decided in this manner, the user can swing the first in-body wash bidet part 30 with a desired angle, thereby determining the installation angle of the first in-body wash bidet part 30.

Under this state, the water introduced into the cylinder 53 is supplied to the interior of the first in-body wash bidet part 30 via the piston member 54 and the water guide pipe 52 of the support member 51. Subsequently, the water is sprayed into the intestine or the vagina through the antimicrobial silicon hose 32 of the first in-body wash bidet part 30 that has been extended outwardly and inserted into the intestine or the vagina, thus performing in-body wash operation.

The second in-body wash bidet part 40 positioned at the front side in the drawings can be displaced forward or backward or can be rotated by means of the second position adjustor 60. In order for the water to reach the second in-body wash bidet part 40, the water is first supplied into the cylinder 63 to thereby move forward the piston cylinder 64 and the piston member 65 one after another, in response to which the second in-body wash bidet part 40 is caused to move forward to the center of the toilet bowl.

At this moment, the second in-body wash bidet part 40 can be rotated by the user because the cylinder 63 remains rotatably mounted on the main body 10. Under the condition that the position of the second in-body wash bidet part 40 is decided in this manner, the user can swing the second in-body wash bidet part 40 with a desired angle, thereby determining the installation angle of the second in-body wash bidet part 40. The first in-body wash bidet part 30 and the second in-body wash bidet part 40 are opposed to each other about the main wash bidet part 15 and, therefore, are rotated in the opposite directions.

At the time when the water is stopped from supplying to the first in-body wash bidet part 30 or the second in-body wash bidet part 40, they are returned to the initial positions under the action of the spring members 55 and 66 retained on the piston members 54 and 65 and the piston cylinder 64. Then, the user can rotate the first in-body wash bidet part 30 and the second in-body wash bidet part 40 to conceal them under the main body 10, meaning that the bidet device can be normally used as a typical purpose without having to expose the first in-body wash bidet part 30 or the second in-body wash bidet part 40.

Accordingly, the user can bring the first in-body wash bidet part 30 or the second in-body wash bidet part 40 into a desired position and can adjust the angle thereof under that condition, which is very important in improving the convenience in use.

In this connection, the in-body wash bidet part 30 or 40 may have three types of structures as set forth below.

FIG. 10 is an exploded perspective view illustrating a first example of an in-body wash bidet part, one of major elements of the present invention. FIG. 11 is an exploded perspective view illustrating a second example of the in-body wash bidet part, one of major elements of the present invention. FIG. 12 is an exploded perspective view illustrating a third example of the in-body wash bidet part, one of major elements of the present invention.

A first example of the in-body wash bidet part 30 or 40 employed in the bidet device for toilet bowls of the present invention includes a bidet body 31 or 41 spaced apart from the main body 10 by a predetermined interval and supplied with the water through the position adjustor 50 or 60, an antimicrobial silicon hose 32 or 42 extendible from the bidet body 31 or 41 for insertion into the intestine or the vagina, a water ejection mouth cap 33 or 43 coupled to a tip end of the bidet body 31 or 41, through a sealing member 39 or 49 inserted around the antimicrobial silicon hose 32 or 42, for supporting the antimicrobial silicon hose 32 or 42 on the bidet body 31 or 41, a stopper member 34 or 44 fixed to a base end of the antimicrobial silicon hose 32 or 42 for preventing removal of the antimicrobial silicon hose 32 or 42 from the water ejection mouth cap 33 or 43, and a fixture ring 37 or 47 fitted to the stopper member 34 or 44 from around the antimicrobial silicon hose 32 or 42 for retaining the stopper member 34 or 44 in place.

The in-body wash bidet part 30 or 40 may further include a bidet cap 35 or 45 coupled to the tip end of the bidet body 31 or 41 for concealing the antimicrobial silicon hose 32 or 42 against exposure to the outside.

In the in-body wash bidet part configured as above, the antimicrobial silicon hose can be extended from the bidet body and then inserted into the intestine or the vagina for conducting in-body wash with the water supplied.

When extended, the antimicrobial silicon hose 32 or 42 is prevented from removal by means of the stopper member 34 or 44 and the water ejection mouth cap 33 or 43. The antimicrobial silicon hose 32 or 42 can also be prevented from exposure to the outside by coupling the bidet cap 35 or 45 to the bidet body 31 or 41.

A second example of the in-body wash bidet part 30 or 40 employed in the bidet device for toilet bowls of the present invention is substantially the same as the first example noted above, except that a spring 36 or 46 is insertedly fitted around the antimicrobial silicon hose 32 or 42.

The spring 36 or 46 fitted around the antimicrobial silicon hose 32 or 42 is retained in place by the stopper member 34 or 44 and serves to return the antimicrobial silicon hose 32 or 42 into an initial position when the water is not supplied.

The in-body wash bidet part may also be configured into a vibration type as a third example. The vibration type in-body wash bidet part 30' includes a bidet body 31' spaced apart from the main body 10 by a predetermined interval and supplied with the water through the position adjustor 50, a vibrator enclosure 37' threadedly engaged with a bottom end of the bidet body 31' and having a vibrator 37" enclosed within the vibrator enclosure 37', a spring 38" provided below the vibrator 37"for absorbing the vibration of the vibrator 37", a vibratory penetrator 38 protruding from the bidet body 31' for insertion into an intestine or a vagina and spraying the water undulated by the vibratory motion of the vibrator 37", a water ejection mouth cap 33' insertedly fitted around the vibratory penetrator 38 and coupled to the bidet body 31' for supporting the vibratory penetrator 38, and a connector member 39' provided on a top end of the vibrator 37" for transmitting the vibration to the vibratory penetrator 38.

In this regard, the vibratory penetrator 38 includes an antimicrobial silicon hose 32' extending from the bidet body 32' and having a protrusion 32" at a tip end, a vibration bar 38' placed within the antimicrobial silicon hose 32' and coupled at a base end to the connector member 39' for causing undulatory motion to the water, and a support member 34' coupled to the bidet body 31' and engaged with the protrusion 32" for inhibiting the antimicrobial silicon hose 32' from falling into the bidet body 31'.

The vibratory penetrator 38 is detachably attached to the bidet body 31' There is further provided a bidet cap 35' that can be coupled to the bidet body 31' when the vibratory penetrator 38 is detached from the bidet body 31'.

The vibration-type in-body wash bidet part configured as above can initialize the bond of water molecules and thus can provide improved water purification effect by causing undulatory motion to the water through the use of vibration of the vibrator.

The vibration generated in the vibrator 37" is transmitted to the vibration bar 38' via the connector member 39' and the vibration bar 38' is vibrated within the antimicrobial silicon hose 32' to cause undulatory motion to the water. This normalizes the abnormal bond of water molecules that stems from contamination of the water or other causes, thereby improving the cleansing effect of the water sprayed into the intestine or the vagina.

In the bidet device for toilet bowls of the present invention, the position of the in-body wash bidet part 30 or 40 can be decided manually or automatically.

FIG. 13 is a perspective view showing a bidet device for toilet bowls in accordance with a third embodiment of the present invention. FIG. 14 is an exploded perspective view illustrating a first rotation means, one of major elements of the bidet device in accordance with the third embodiment. FIG. 15 is a perspective view showing a bidet device for toilet bowls in accordance with a fourth embodiment of the present invention. FIG. 16 an exploded perspective view illustrating a second rotation means, one of major elements of the bidet device in accordance with the fourth embodiment.

Specifically, the bidet device for toilet bowls of the present invention may include a rotation means 80 or 90 for concealing the in-body wash bidet part 30 or 40 under the main body 10 or taking out the same to the outside.

The rotation means 80 or 90 may be a manual type in which the user directly adjusts the position of the in-body wash bidet part 30 or 40 by use of a handle 81 or 91, an automatic type in which the position of the in-body wash bidet part 30 or 40 is automatically adjusted in response to the supply of the water, or the combination type in which the manual type and the automatic type are used in common. Description will be given to the combination type in the present embodiment.

The in-body wash bidet part 30 or 40 includes a first in-body wash bidet part 30 whose antimicrobial silicon hose can be inserted into one of the intestine and the vagina and a second in-body wash bidet part 40 whose antimicrobial silicon hose can be inserted into the other of the intestine and the vagina. The bidet device for toilet bowls includes a first rotation means 80 for rotating the second in-body wash bidet part 40 and a second rotation means 90 for rotating the first in-body wash bidet part 30.

The first rotation means 80 includes a water guide pipeline 83 hingedly secured to the second in-body wash bidet part 40 for supplying the water to the second in-body wash bidet part 40 with an antimicrobial silicon hose, a distributor pipe 82 communicating with the water guide pipeline 83 and connected to the handle 81 for forward and backward movement, and a piston member 85 positioned inside a cylinder 84, which in turn is affixed to the main body 10, and adapted to move forward and backward by the water supplied to the distributor pipe 82 through a water inlet pipe 86, to thereby displace the distributor pipe 82.

The second rotation means 90 includes a water guide pipeline 93 hingedly secured to the first in-body wash bidet part 30 for supplying the water to the first in-body wash bidet part 30 with an antimicrobial silicon hose, a distributor pipe 92 having a water inlet port and remaining coupled with the water guide pipeline 93, a piston member 95 adapted to move forward and backward within a cylinder 94, a piston cap 96 coupled to the piston member 95 and kept in communication with the distributor pipe 92, and a rod 97 interconnecting the cylinder 94 and the handle 91.

Preferably, a spring (not shown) may be insertedly fitted to around the piston member 85 or 95 so that the spring can return the piston member 85 or 95 to an initial position when the water is not supplied.

In the bidet device for toilet bowls of the present invention configured as above, the in-body wash bidet part can be manually operated using the handle to decide the position thereof or can be automatically operated as the water is supplied.

If the handle 81 or 91 is moved forward or backward, the first in-body wash bidet part 30 or the second in-body wash bidet part 40 coupled to the end portion of the water guide pipeline 83 or 93 is rotated and moved toward the center of the toilet bowl under the action of the water guide pipeline 83 or 93 hingedly affixed to the main body 10. At this moment, even though the handle 81 or 91 is not operated, the water supplied to the cylinder 84 or 94 through the distributor pipe 82 or 92 causes the piston member 85 or 95 to move forward, thus rotating the first in-body wash bidet part 30 or the second in-body wash bidet part 40. In case of the water supply being interrupted, the piston member 85 or 95 is retracted by the spring to thereby bring the first in-body wash bidet part 30 or the second in-body wash bidet part 40 into the initial position.

Depending on the manner in which the in-body wash bidet part is caused to move, the bidet device for toilet bowls of the present invention may take many different forms.

FIG. 17 is a perspective view showing a bidet device for toilet bowls in accordance with a fifth embodiment of the present invention. FIG. 18 is a perspective view showing a bidet device for toilet bowls in accordance with a sixth embodiment of the present invention. FIG. 19 is an exploded perspective view illustrating a handgrip part, one of major elements of the bidet device in accordance with the sixth embodiment.

A bidet device for toilet bowls of the present invention includes a main body 10 mounted on a rear side of a toilet bowl and having a control part C at one side, the main body 10 provided with an extension portion 18 protruding a predetermined extent in a front direction of the toilet bowl at an opposite position from the control part C, a fixing member 19 provided at a terminal end of the extension portion 18 of the main body 10 for affixing the extension portion 18 to the toilet bowl, a main wash bidet part 15 provided below a center protrusion 11 of the main body 10 for spraying water to cleanse posterior areas of a user, at least one in-body wash bidet part 100 or 105 attached to the main body 10 for cleansing one of an intestine and a vagina, and a position adjustor 110 provided on the extension portion 18 of the main body 10 for adjusting the position of the in-body wash bidet part 100 or 105 and for supplying the water to the in-body wash bidet part 100 or 105.

The position adjustor 110 includes a handgrip 111 of a repeatedly bent shape, one end of which protrudes upwardly from the extension portion 18 and the other end of which is connected to the in-body wash bidet part 100, the handgrip 111 having a water guide pipe 117 formed inside the handgrip 111, and a guide portion provided on the extension portion 18 of the main body 10 for guiding the movement of the handgrip 111.

The guide portion is comprised of a guide groove 112 formed on the extension portion 18 of the main body 10 in a front-rear direction of the toilet bowl and a guide block 114 fitted to the guide groove 112 for forward and backward movement along the guide groove 112, the guide block 114 having a slot 113 through which the handgrip 111 passes.

In this respect, the in-body wash bidet part includes a first in-body wash bidet part 100 and a second in-body wash bidet part 105 spaced apart from each other by a pre-determined distance. The water guide pipe 117 formed in the handgrip 111 is also provided in dual numbers, one of which communicates with the first in-body wash bidet part 100 and the other of which is in communication with the second in-body wash bidet part 105. The first in-body wash bidet part 100 is connected to the handgrip 111 by means of a tee 115, while the second in-body wash bidet part 105 is connected to the tee 115 by means of an elbow 116.

In the bidet device for toilet bowls of the present invention configured as above, the in-body wash bidet part can be moved in a front-rear direction or a left-right direction and also can be rotated by operating the handgrip.

More specifically, the in-body wash bidet part 100 or 105 is normally placed under the main body 10 and can be moved toward the center of the toilet bowl by displacing the guide block 113 along the guide groove 112 through the use of the handgrip 111. The position of the in-body wash bidet part 100 or 105 is decided by displacing the handgrip 111 in the left-right direction along the slot 114 of the guide block 113. Sub-sequently, the handgrip 111 is grasped and rotated about the slot 114 of the guide block 113 to thereby adjust the installation angle of the in-body wash bidet part 100 or 105 within a predetermined extent. Under this condition, the water is supplied to the in-body wash bidet part 100 or 105 through the water guide pipe 117 of the handgrip, thus cleansing the intestine or the vagina.

Accordingly, the user can directly adjust the position and angle of the in-body wash bidet part 100 or 105 for the sake of in-body wash, which enhances the convenience in use. As in the foregoing embodiment, there may be further provided a cylinder member (not shown) that can displace the guide block 113 forward and backward along the guide groove 112 at the time when the water is supplied to the first in-body wash bidet part 100 or the second in-body wash bidet part 105. This makes sure that, even though the guide block 113 is not manually displaced by use of the handgrip 111, the guide block 113 is automatically moved in response to the supply of the water, thereby bringing the first in-body wash bidet part 100 or the second in-body wash bidet part 105 to the center of the toilet bowl. In a nutshell, it is possible for the position adjustor 110 to employ one of the three types, namely, the manual type using only the handgrip 111, the automatic type using only the cylinder member and the combination type incorporating the manual type and the automatic type.

FIG. 20 is a perspective view showing a bidet device for toilet bowls in accordance with a seventh embodiment of the present invention. FIG. 21 is a perspective view showing a bidet device for toilet bowls in accordance with an eighth embodiment of the present invention.

A bidet device for toilet bowls of the present invention includes a main body 10 mounted on a rear side of a toilet bowl and having a control part C at one side, a main wash bidet part 15 provided below a center protrusion 11 of the main body 10 for spraying water to cleanse posterior areas of a user, at least one in-body wash bidet part 100 or 105 attached to the main body 10 for cleansing one of an intestine and a vagina, a handgrip part 120 movable in a left-right direction along the main body 10 and having a water guide passage formed inside the handgrip part 120, a water feeding pipe 125 for allowing the handgrip part 120 to communicate with the in-body wash bidet part 100 or 105, and a guide member mounted on the main body 10 for guiding the movement of the handgrip part 120.

The handgrip part 120 includes a linear motion portion 121 rectilinearly movable along the main body 10, a rotation portion 122 coupled to the linear motion portion 121 for rotational movement within a predetermined extent, the water feeding pipe 125 connected to the rotation portion 122, a connector portion 123 provided between and interconnecting the linear motion portion 121 and the rotation portion 122, and a guide cap 124 coupled to a top end of the connector portion 123 through a tip end of the linear motion portion 121.

The guide member includes a guide block 126 coupled to the guide cap 124 for guiding linear movement of the linear motion portion 121, a first stopper 127 mounted on the main body 10 in such a manner as to enclose the guide block 126 and the rotation portion 122 and adapted to restrain rotational movement of the rotation portion 122 to a predetermined extent, and a second stopper 128 provided closer to the center of the main body 10 than the first stopper 127 is and formed in a larger size than the first stopper 127.

In the bidet device for toilet bowls of the present invention configured as above, the in-body wash bidet part can be rectilinearly moved along the main body and then rotated through the use of the handgrip part to decide the position of the in-body wash bidet part.

In other words, if the handgrip part 120 is displaced along the main body 10, it makes rectilinear movement with the aid of the guide cap 124 coupled to the guide block 126. Subsequently, if the in-body wash bidet part 100 or 105 is grasped and rotated, the rotation portion 122 is caused to rotate about the connector portion 123 of the handgrip part 120. At this time, the guide block 126 is rotated together with the rotation portion 122 and is restrained from any excessive rotation by means of the first stopper 127 and the second stopper 128.

Accordingly, the user can directly adjust the position and angle of the in-body wash bidet part 100 or 105, which enhances the convenience in use. Furthermore, there may be further provided a cylinder member (not shown) that can displace the handgrip part 120 forward and backward at the time when the water is supplied to the first in-body wash bidet part 100 or the second in-body wash bidet part 105. This makes sure that, even though the handgrip part 120 is not manually operated, the handgrip part 120 is automatically moved forward and backward. In a nutshell, it is possible to employ one of the three types, namely, the manual type manually operating the handgrip part 120, the automatic type using only the cylinder member and the combination type incorporating the manual type and the automatic type.

Moreover, the in-body wash bidet part includes a first in-body wash bidet part 100 positioned at one side of the main wash bidet part 15 and a second in-body wash bidet part 105 lying in an opposing relationship with the first in-body wash bidet part 100. The water may be selectively supplied to one of the first in-body wash bidet part 100 and the second in-body wash bidet part 105. The handgrip part 120 for operating the first in-body wash bidet part 100 is substantially the same in configuration and operation as that of the second in-body wash bidet part 105, except for the length and shape of the linear motion portion 121 which varies due to the difference in distance.

FIG. 22 is a perspective view showing a bidet device for toilet bowls in accordance with a ninth embodiment of the present invention. FIG. 23 is a perspective view showing a bidet device for toilet bowls in accordance with a tenth embodiment of the present invention. FIG. 24 is an exploded perspective view illustrating a cylinder member, one of major elements of the bidet device in accordance with the tenth embodiment. FIG. 25 is a perspective view showing a bidet device for toilet bowls in accordance with an eleventh embodiment of the present invention. FIG. 26 is an exploded perspective view illustrating a main wash bidet part and a front bidet part, one of major elements of the bidet device in accordance with the eleventh embodiment.

According to the ninth embodiment of the present invention, a bidet device for toilet bowls includes a main body 10 mounted on a rear side of a toilet bowl and having a control part C at one side, the main body 10 provided with two extension portions 18 protruding frontward a predetermined extent along side portions of the toilet bowl, fixing members 19 provided at a terminal end of each of the extension portions 18 of the main body 10 for affixing the extension portions 18 to the toilet bowl, a main wash bidet part 15 provided below a center protrusion 11 of the main body 10 for spraying water to cleanse posterior areas of a user, at least one in-body wash bidet part 100 attached to the main body 10 for cleansing one of an intestine and a vagina, and a position adjustor 130 for adjusting the position of the in-body wash bidet part 100.

The position adjustor 130 includes a handgrip 131 mounted on the extension portions 18 of the main body 10 across the toilet bowl and having a water guide passage formed inside the handgrip 131, a pair of guide blocks 133 movable forward and backward along guide grooves 132 respectively formed on the extension portions 18, the handgrip 131 adapted to pass through the guide blocks 133, and a pair of cylinder members for displacing the guide blocks 133 forward and backward depending on the supply of water.

Each of the cylinder members includes a cylinder 134 provided at a rear side of each of the extension portions 18 of the main body 10, a piston 135 fitted into the cylinder 134 and coupled at a tip end to each of the guide blocks 133, a spring 136 insertedly fitted to around the piston 135 for displacing the piston 135 backward and returning each of the guide blocks 133 into an initial position at the time when the water supply is cut off, and a cylinder cap 137 threadedly coupled to a rear end of the cylinder 134 and having a water inlet port and a water outlet port.

The cylinder caps 137 of the respective cylinder members are connected to each other by means of a water guide pipe 138 and are provided with check valves 140 at a water inlet port and a water outlet port. Each of the check valves 140 includes a support member 141 threadedly coupled to each of the water inlet port and the water outlet port of the cylinder caps 137 and having a bore formed at a center of the support member 141, a blocking plate 142 for closing off the bore of the support member 141 to interrupt the flow of water, the blocking plate 142 having an outer diameter smaller than that of the water inlet port and the water outlet port, a pair of guide bars 144 formed on the blocking plate 142 and inserted into guide holes 141 of the support member 141, each of the guide bars 144 having a tip end bent in such a manner as to prevent removal from the support member 141, and a spring 143 retained between the support member 141 and the blocking plate 142.

The handgrip 131 is curved such that the in-body wash bidet part 100 can be placed a predetermined distance below a top end of the toilet bowl and has opposite straight portions of a predetermined length extending through the guide blocks 133 for movement in a left-right direction.

In the bidet device for toilet bowls of the present invention configured as above, the in-body wash bidet part can be moved in a forward-backward direction and a left-right direction by use of the handgrip and also can be rotated into a given angular position to thereby adjust the installation angle thereof.

If the guide blocks 133 are moved forward and backward by grasping the handgrip 131, it is possible to place the in-body wash bidet part 100 either below the main body 10 or at the center of the toilet bowl. Furthermore, the installation angle of the in-body wash bidet part 100 can be adjusted by rotating the handgrip 131. The in-body wash bidet part 100 can also be moved in the left-right direction by pulling or pushing the handgrip 131 in a longitudinal direction. At this time, the amount of left-right movement of the in-body wash bidet part 100 is limited by the length of the straight portions of the handgrip 131 and the size of the guide blocks 133.

Instead of displacing the guide blocks 133 forward and backward by use of the handgrip 131, the position of the in-body wash bidet part 100 may be set by allowing the guide blocks 133 to be moved under the pressure of the water supplied to the cylinder members.

The water introduced into the cylinder 134 can displace the piston 135 and hence the guide blocks 133 forward. If the water supply is interrupted, the piston 135 and the guide blocks 133 are moved backward by means of the spring 136, thereby placing the in-body wash bidet part 100 under the main body 10. In this process, the water in the cylinder 134 is slowly drained under the action of resilient force of the spring 136 and does not flow backward due to the presence of the check valves 140.

In the meantime, at least one of the water ejection pipes 16 of the main body 10 may be closed by the water ejection pipe cap 17 when not in use or may be used to supply the water to a shower device S or other external devices. This is applied to all of the embodiments as well as the present embodiment.

The bidet device for toilet bowls of the tenth embodiment is substantially the same as that of the ninth embodiment set forth above but differs in the following aspects. The in-body wash bidet part includes a first in-body wash bidet part 100 and a second in-body wash bidet part 105 symmetrically spaced apart from each other about the main wash bidet part 15. The water guide passage is also provided in dual numbers, one of which communicates with the first in-body wash bidet part 100 and the other of which is in communication with the second in-body wash bidet part 105.

No description will be given in this respect because the bidet device for toilet bowls of the tenth embodiment is the same as that of the ninth embodiment except for the number of the in-body wash bidet part employed.

The bidet device for toilet bowls of the eleventh embodiment is substantially the same as that of the ninth and tenth embodiments set forth above, except that the main wash bidet part is provided on the handgrip and not on the main body. In other words, the main wash bidet part 106 is provided between the first in-body wash bidet part 100 and the second in-body wash bidet part 105. The handgrip 131 has three water guide passages respectively communicating with the main wash bidet part 106, the first in-body wash bidet part 100 and the second in-body wash bidet part 105.

The bidet device for toilet bowls may further include a front bidet part 106 positioned at a front side of the toilet bowl and affixed in place by means of a fixing member 107 for spraying the water supplied through a connector hose 108.

In this regard, each of the main wash bidet part 106 and the front bidet part 106 includes a nozzle 106*a* for spraying the water, a cylinder 106*b* having an internally formed guide groove, a piston 106*c* fitted for communication with the nozzle 106*a* and movable within the cylinder 106*b* in a front-rear direction, the piston 106*c* having a protrusion 106*f* inserted into the guide groove of the cylinder 106*b*, a spring 106*d* fitted to around the piston 106*c* for returning the piston 106*c* to an initial position, and a cylinder cap 106*e* coupled to the cylinder 106*b* and having a water inlet port.

The bidet device for toilet bowls of the eleventh embodiment provides substantially the same effect as provided by that of the ninth embodiment. In addition, it is possible for the user to freely adjust the position of the main wash bidet part 106. The front bidet part 106 provides increased convenience to a female user.

If the water is supplied to the main wash bidet part 106 or the front bidet part 106, the piston 106*c* within the cylinder 106*b* fixedly secured to the handgrip 131 or the toilet bowl is caused to move forward, thus pushing the nozzle 106*a* in a downward direction of the toilet bowl. This enables the nozzle 106*a* to spray the water and perform the bidet wash function at a position lower than the initial position. At this time, the piston 106*c* moves rectilinearly due to the presence of the protrusion 106*f* received in the guide groove, thus precluding the possibility that the nozzle 106*a* is rotated.

If the water supply is interrupted, the piston 106*c* is moved backward by means of the spring 106*d*. This makes it possible to reduce the volume of the main wash bidet part 106 and the front bidet part 106 while not in use.

While the invention has been shown and described in respect of preferred embodiments, this is not intended to limit the scope of the invention by no means. It will be understood by those skilled in the art that various changes and modifications may be made without departing from the spirit and scope of the invention as defined in the following claims.

Industrial Applicability

The present invention finds its application in a bidet device for toilet bowls mounted on a toilet bowl for washing an anus and cleansing an intestine or a vagina.

The invention claimed is:

1. A bidet device for toilet bowls comprising:

a main body (10) mounted on a rear side of a toilet bowl and having a control part (C) at one side;

a main wash bidet part (15) provided below a center protrusion (11) of the main body (10) for spraying water to cleanse posterior areas of a user;

at least one in-body wash bidet part (30 or 40) attached to the main body (10) for cleansing one of an intestine and a vagina;

a purifier part (20) for purifying the water ejected through the main wash bidet part (15) and the in-body wash bidet part (30 or 40);

a water ejection regulator part (14) provided on the control part (C) for selectively supplying the water to one of the main wash bidet part (15) and the in-body wash bidet part (30 or 40); and a position adjustor (50 or 60) for adjusting the position of the in-body wash bidet part (30 or 40), wherein the purifier part (20) is positioned between a temperature control section (12) and a water pressure control section (13) of the control part (C) and includes a filter section (21) comprised of a primary filter (21*a*) for first filtering the water introduced from the temperature control section (12) and an activated carbon filter (21*b*) for enclosing the primary filter (21*a*) to adsorb contaminants of the first filtered water and a sterilizer section (22) provided above the filter section (21) and having a sterilizer (22') for sterilizing the water prior to being supplied to the water pressure control section (13).

2. The bidet device for toilet bowls as recited in claim 1, wherein the main body (10) includes a plurality of water outlet pipes (16) connected to the water outlet ports (14*j*) of the water ejection regulator part (14), the water outlet ports (14*j*) and the water outlet pipes (16) are provided in a greater number than the actual number of the bidet parts, and the water outlet pipe (16) not in use is closed off by means of a pipe cap (17).

3. The bidet device for toilet bowls as recited in claim 1, further comprising a rotation means (80 or 90) for concealing the in-body wash bidet part (30 or 40) under the main body (10) or taking out the in-body wash bidet part (30 or 40) to the outside.

4. The bidet device for toilet bowls as recited in claim 3, wherein the rotation means (80 or 90) is selected from the group consisting of a manual type in which a user directly adjusts the position of the in-body wash bidet part (30 or 40) by use of a handle (81 or 91), an automatic type in which the position of the in-body wash bidet part (30 or 40) is automatically adjusted in response to the supply of the water and the combination type in which the manual type and the automatic type are used in common.

5. The bidet device for toilet bowls as recited in claim 3, wherein the rotation means (80 or 90) includes a water guide pipeline (83 or 93) hingedly secured to the in-body wash bidet part (30 or 40) for supplying the water to the in-body wash bidet part (30 or 40) with an antimicrobial silicon hose, a distributor pipe (82 or 92) communicating with the water guide pipeline (83 or 93) and connected to a handle (81 or 91) for forward and backward movement, and a piston member (85 or 95) positioned inside a cylinder (84 or 94), which in turn is affixed to the main body (10), and adapted to move forward and backward by the water supplied to the distributor pipe (82 or 92) through a water inlet pipe (86 or 96), to thereby displace the distributor pipe (82 or 92).

6. A bidet device for toilet bowls comprising:

a main body (10) mounted on a rear side of a toilet bowl and having a control part (C) at one side;

a main wash bidet part (15) provided below a center protrusion (11) of the main body (10) for spraying water to cleanse posterior areas of a user;

at least one in-body wash bidet part (30 or 40) attached to the main body (10) for cleansing one of an intestine and a vagina;

a purifier part (20) for purifying the water ejected through the main wash bidet part (15) and the in-body wash bidet part (30 or 40);

a water ejection regulator part (14) provided on the control part (C) for selectively supplying the water to one of the main wash bidet part (15) and the in-body wash bidet part (30 or 40); and a position adjustor (50 or 60) for adjusting the position of the in-body wash bidet part (30 or 40), wherein the water ejection regulator part (14) includes a body (14*a*) having a plurality of internal compartments and a plurality of water outlet ports (14*j*) provided in an one-to-one relationship with the compartments, a distributor plate (14*d*) coupled to an upper side of the body (14*a*) through a packing (14*e*) and having a plurality of holes corresponding to the compartments of the body (14*a*), a rotary plate (14*g*) rotatably positioned above the distributor plate (14*d*) and having an aperture for communication with one of the holes of the a distributor plate (14*d*), a cover (14*b*) having a water inlet port and threadedly coupled to the body (14*a*), a connector (14*f*) penetrating through a hole formed on a top end of the cover (14*b*), the connector (14*f*) having a top end combined with an operating knob (14*c*) and a bottom end combined with the rotary plate (14*g*), a spring (14*h*) insertedly fitted to a lower extension of the connector (14*f*) for pressing the rotary plate (14*g*) against the distributor plate (14*d*), and a spring seat (14*i*) coupled to the connector (14*f*) for supporting the spring (14*h*).

7. The bidet device for toilet bowls as recited in claim 6, wherein the main body (10) includes a plurality of water outlet pipes (16) connected to the water outlet ports (14*j*) of the water ejection regulator part (14), the water outlet ports (14*j*) and the water outlet pipes (16) are provided in a greater number than the actual number of the bidet parts, and the water outlet pipe (16) not in use is closed off by means of a pipe cap (17).

8. A bidet device for toilet bowls comprising:

a main body (10) mounted on a rear side of a toilet bowl and having a control part (C) at one side;

a main wash bidet part (15) provided below a center protrusion (11) of the main body (10) for spraying water to cleanse posterior areas of a user;

at least one in-body wash bidet part (30 or 40) attached to the main body (10) for cleansing one of an intestine and a vagina;

a purifier part (20) for purifying the water ejected through the main wash bidet part (15) and the in-body wash bidet part (30 or 40);

a water ejection regulator part (14) provided on the control part (C) for selectively supplying the water to one of the main wash bidet part (15) and the in-body wash bidet part (30 or 40); and a position adjustor (50 or 60) for adjusting the position of the in-body wash bidet part (30 or 40), wherein the in-body wash bidet part (30 or 40) includes a bidet body (31 or 41) spaced apart from the main body (10) by a predetermined interval and supplied with the water through the position adjustor (50 or 60), an antimicrobial silicon hose (32 or 42) extendible from the bidet body (31 or 41) for insertion into the intestine or the vagina, a water ejection mouth cap (33 or 43) coupled to a tip end of the bidet body (31 or 41), through a sealing member (39 or 49) inserted around the antimicrobial silicon hose (32 or 42), for supporting the antimicrobial silicon hose (32 or 42) on the bidet body (31 or 41), a stopper member (34 or 44) fixed to a base end of the antimicrobial silicon hose (32 or 42) for preventing removal of the antimicrobial silicon hose (32 or 42) from the water ejection mouth cap (33 or 43), and a fixture ring (37 or 47) fitted to the stopper member (34 or 44) from around the antimicrobial silicon hose (32 or 42) for retaining the stopper member (34 or 44) in place.

9. The bidet device for toilet bowls as recited in claim 8, wherein the in-body wash bidet part (30 or 40) further includes a spring (36 or 46) insertedly fitted around the antimicrobial silicon hose (32 or 42) and retained in place by the stopper member (34 or 44) for returning the antimicrobial silicon hose (32 or 42) to an initial position.

10. A bidet device for toilet bowls comprising:

a main body (10) mounted on a rear side of a toilet bowl and having a control part (C) at one side;

a main wash bidet part (15) provided below a center protrusion (11) of the main body (10) for spraying water to cleanse posterior areas of a user;

at least one in-body wash bidet part (30 or 40) attached to the main body (10) for cleansing one of an intestine and a vagina;

a purifier part (20) for purifying the water ejected through the main wash bidet part (15) and the in-body wash bidet part (30 or 40);

a water ejection regulator part (14) provided on the control part (C) for selectively supplying the water to one of the main wash bidet part (15) and the in-body wash bidet part (30 or 40); and a position adjustor (50 or 60) for adjusting the position of the in-body wash bidet part (30 or 40), wherein the in-body wash bidet part is a vibration type in-body wash bidet part (30') and includes a bidet body (31') spaced apart from the main body (10) by a predetermined interval and supplied with the water through the position adjustor (50), a vibrator enclosure (37') threadedly engaged with a bottom end of the bidet body (31') and having a vibrator (37") enclosed within the vibrator enclosure (37'), a spring (38") provided below the vibrator (37") for absorbing the vibration of the vibrator (37"), a vibratory penetrator (38) protruding from the bidet body (31') for insertion into the intestine or the vagina and spraying the water undulated by the vibratory motion of the vibrator (37"), a water ejection mouth cap (33') insertedly fitted around the vibratory penetrator (38) and coupled to the bidet body (31') for supporting the vibratory penetrator (38), and a connector member (39') provided on a top end of the vibrator (37") for transmitting the vibration to the vibratory penetrator (38).

11. The bidet device for toilet bowls as recited in claim 10, wherein the vibratory penetrator (38) includes an antimicrobial silicon hose (32') extending from the bidet body (32') and having a protrusion (32") at a tip end, a vibration bar (38') placed within the antimicrobial silicon hose (32') and coupled at a base end to the connector member (39') for causing undulatory motion to the water, and a support member (34') coupled to the bidet body (31') and engaged with the protrusion (32") for inhibiting the antimicrobial silicon hose (32') from falling into the bidet body (31').

12. A bidet device for toilet bowls comprising:

a main body (10) mounted on a rear side of a toilet bowl and having a control part (C) at one side;

a main wash bidet part (15) provided below a center protrusion (11) of the main body (10) for spraying water to cleanse posterior areas of a user;

at least one in-body wash bidet part (30 or 40) attached to the main body (10) for cleansing one of an intestine and a vagina;

a purifier part (20) for purifying the water ejected through the main wash bidet part (15) and the in-body wash bidet part (30 or 40);

a water ejection regulator part (14) provided on the control part (C) for selectively supplying the water to one of the main wash bidet part (15) and the in-body wash bidet part (30 or 40); and a position adjustor (50 or 60) for adjusting the position of the in-body wash bidet part (30 or 40), wherein the position adjuster (50 or 60) includes a support member (51 or 61) rotatably supporting a bidet body (31 or 41) with an antimicrobial silicon hose (32 or 42) and having an internally arranged water guide pipe (52 or 62), a cylinder (53 or 63) rotatably attached to the main body (10), a piston member (54 or 65) positioned inside the cylinder (53 or 63) and coupled to the support member (51 or 61) for forward and backward movement under the action of a water pressure, a spring member (55 or 66) insertedly fitted to the piston member (54 or 65) for returning the piston member (54 or 65) into an initial position when the water pressure is weakened, and a cylinder cap (56 or 67) coupled to a rear end of the cylinder (53 or 63) and having a water inlet port.

* * * * *